US006070373A

United States Patent [19]

Diamond

[11] Patent Number: 6,070,373

[45] Date of Patent: Jun. 6, 2000

[54] RIGID STELLATE NON-RECTILINEAR POLYGONS FORMING A FAMILY OF CONCAVE POLYHEDRONS HAVING DISCRETE INTERIORS AND EXTERIORS

[76] Inventor: Gary Diamond, 316 N. Maple St., #242, Burbank, Calif. 91505

[21] Appl. No.: 08/686,316

[22] Filed: Jul. 25, 1996

[51] Int. Cl.[7] ..... E04B 1/34

[52] U.S. Cl. ..... 52/81.3; 52/81.1; 52/DIG. 10

[58] Field of Search ..... 52/80.1, 81.1, 52/81.2, 81.4, 81.5, 745.19, 745.2, DIG. 10, 637, 638, 655.1, 653.1

[56] References Cited

U.S. PATENT DOCUMENTS

| | | | |
|---|---|---|---|
| 3,820,299 | 6/1974 | Verholt | 52/282.2 |
| 4,115,963 | 9/1978 | Lubov | 52/DIG. 10 |
| 4,551,726 | 11/1985 | Berg | 52/81.1 X |
| 4,611,441 | 9/1986 | Wickens | 52/81.4 |
| 4,652,170 | 3/1987 | Lew | 52/282.2 X |
| 4,719,726 | 1/1988 | Bergman | 52/81.4 |
| 5,313,751 | 5/1994 | Wittler | 52/281 X |
| 5,540,013 | 7/1996 | Diamond | 52/81.5 |
| 5,647,171 | 10/1997 | Hunts | 52/282.2 X |

*Primary Examiner*—Robert Canfield

[57] ABSTRACT

A structure formed from a new family of polyhedral models and rigid structures. The structure having discrete interior and exterior elements, and is formed from a plurality of rigid-stellate polygonal modules. Each rigid-stellate polygonal module has at least three polygonal structures coupled to a rigid stellate connector or axis by a base edge. The angle subtended between each of the at least three polygonal structures may be varied by changing the connector.

57 Claims, 34 Drawing Sheets

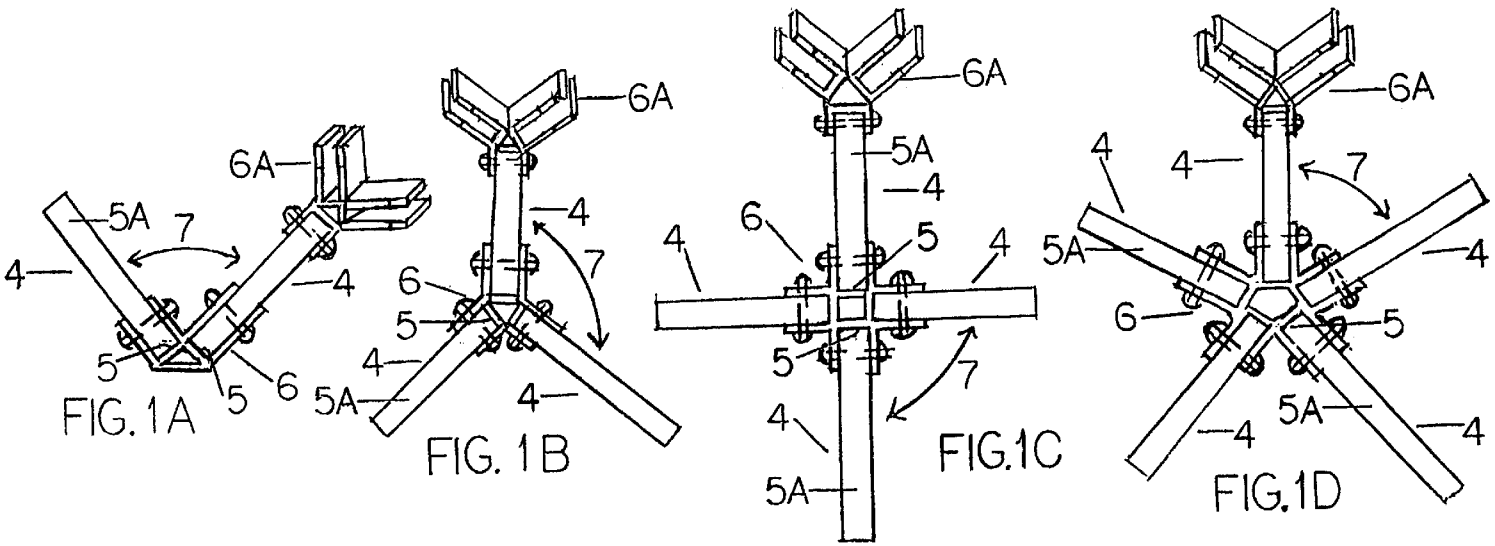
FIG. 1A
FIG. 1B
FIG. 1C
FIG. 1D
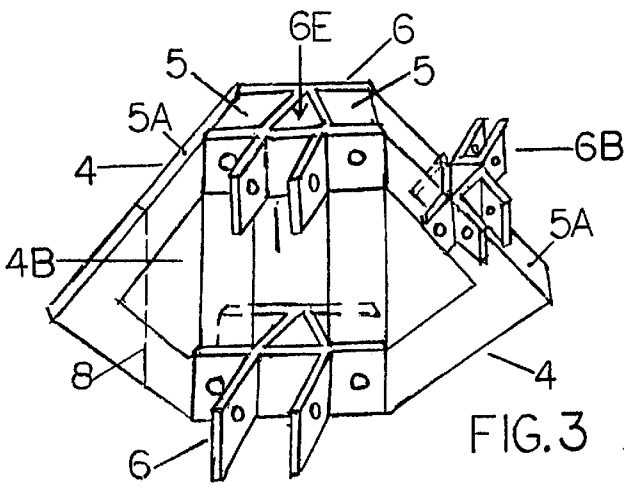
FIG. 3
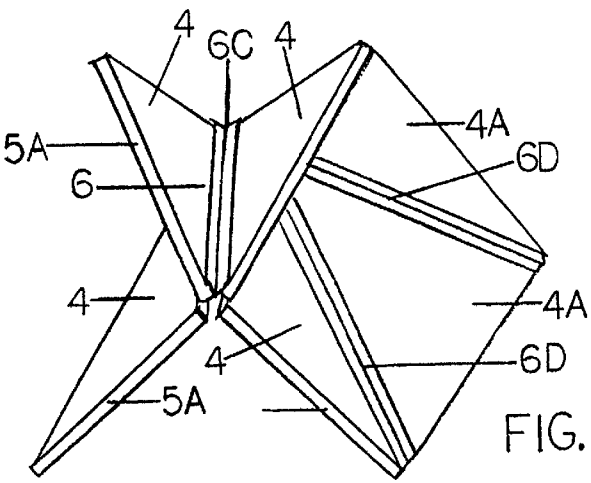
FIG. 2

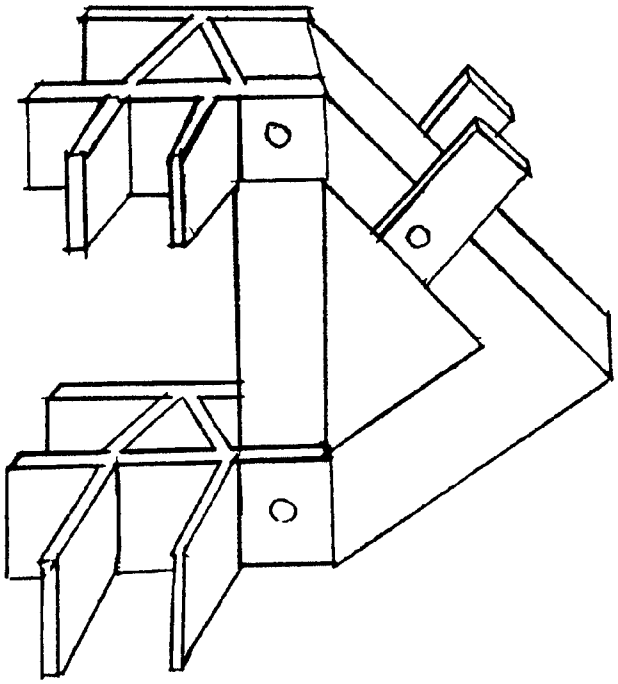
FIG. 5
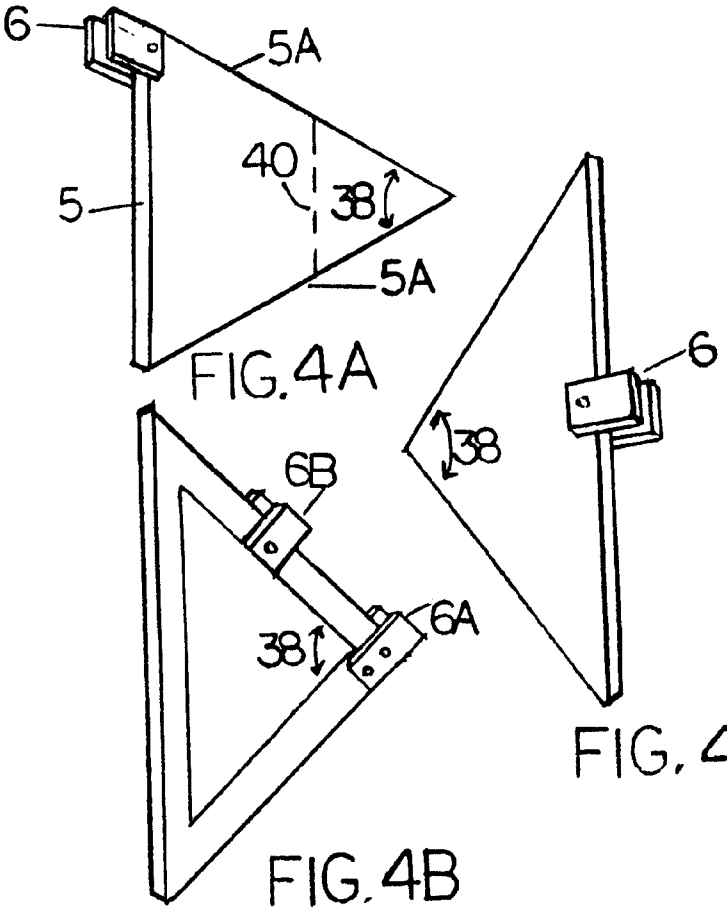
FIG. 4A
FIG. 4C
FIG. 4B

RIGID STELLATE NON-RECTILINEAR POLYGONS FORMING A FAMILY OF CONCAVE POLYHEDRONS HAVING DISCRETE INTERIORS AND EXTERIORS

BACKGROUND

1. Field of Invention

Embodiments of this invention relate to complex concave deltahedral polyhedral structures formed of the multiple use of a basic rigid stellate modular structure. The basic stellate module is made of joined non-rectilinear polygons, joined at coincident base edges of each of the polygons. The multiple basic modules are joined to each other along the additional remaining side edges of the non-rectilinear polygons. A family of diverse concave polyhedrons is taught, many structures very different in form one from another. The non-rectilinear polygons within a basic module are rigidly formed in stellate orientations with various different appropriate angles of attitude of the several polygons one to another within a basic module being possible. First, at least two multiple basic stellate modules are joined together. Then the continued joining together of additional basic modules along their non-base edges to the first two basic modules joined, progressively triangulates, rigidifies, strengthens and progressively completes the form of a complex concave rigid polyhedron.

In particular embodiments of this invention relate to complex concave polyhedral frameworks, specifically to such rigid frameworks having discrete, different forms and surfaces being formed and defined at the exterior and at the interior of the frameworks or on either side of a substantially polyhedral framework model, which are formed of rigidly fixed and stellately joined non-rectilinear polygons. The basic teaching of the present invention is a rigid stellate geometric module formed of joined non-rectilinear polygons which acts as a repetitively used building block, which when used with others of like kind forms previously unknown complex concave polyhedral models having different discrete triangulated rigid structures at the interior and the exterior of the models.

2. Description of Prior Art

Many different modular structures made from linear struts forming rigid frameworks are known in the prior art. Each solves a particular problem, for example, ease of erection, or of manufacturing from a simpler or more cost effective module.

In some applications, for example, a small manufacturer, or a building program requiring maximum diversity from a minimum inventory or in the trusses for space stations in outer space, a very simply assembled system having a limited number of parts is needed to produce a rigid structure. Such prior art structural systems contain the following number of disadvantages:

(a) In the prior art, for a given framework system its linear struts and connectors can only form a limited number of discrete framework structures. To achieve a different final framework or a variety of final frameworks, different initial struts and framework subassemblies are required.

(b) In some cases complex and costly connector modules, known in the art as nodes have been taught as required to achieve a versatile amount of diversity for a single framework system. In the prior art, any attempt to achieve a very complex and diverse number of different structural arrays of frameworks from the same modular structural system has not been possible without supplying a number of costly additional connectors, or complex connectors having many different apertures or recesses in the same node to recieve the placement of a linear strut in order to orient variously a given geometrical framework.

(c) In attempting solutions to these problems of diversity and variety, the prior art has relied on either clever ways to unfold or erect frameworks, or provided complex specialized shapes of connectors and struts, in essence, attempting streamlining and simplifying ways to achieve known structures through the formation of complex and costly new modules. Obviously, this is a disparity and a contradiction; if, uniform low-cost ends are desired but high- tech methods are employed.

(d) The frameworks achieved by the prior art were always previously known geometric polyhedral frameworks, similar to known space frames and other known frames of the prior art. They were more costly and complex in order to achieve some diversity, but finally achieved only preexisting known geometric forms, and failed to teach any new polyhedral forms from those known in the prior geometric art.

(e) In addition, the framework systems which achieved some diversity in the prior art, which were not traditional known space frame systems were thin section shell-like structures with the interior structure merely being the underside of the same structural elements at the exterior of the structure, or thin substantially planar frames, being only one structural member deep, without substantial depth of stiffening, such as geodesic domes or similar lightweight structures, and therefore not able to resist substantially large imposed loads. Also these thin-shelled structures being only exterior structures, contained no integral devices to achieve the formation of differentiation of interior space for usefulness.

(f) The prior art then contained no frameworks systems which were extremely diverse from a minimal device and also able to resist large imposed loads from both the exterior and the interior of the framework. In general, geodesic domes have traditional rectilinear structures used at their interiors, which are not joined to the exterior frame. Traditional spaceframes, and thin shells, because of their high cost and due to the complexity of the form of their nodes and struts and labor intensiveness required are used in only limited ways in building construction, for example as a featured design element only.

(g) Therefore these prior art innovations, were never able to teach a very simple module made from simple and known parts, and a few number of parts, which nonetheless formed new, innovative frameworks of a great diverse variety of types of frameworks all made from the same few simple linear structural elements. Nor have prior art frameworks formed from simple structural modules ever been able to teach new concave polyhedral frameworks of new geometries never before known, and which might have a diversity of applications in varying, different required situations, and might resist large loads, and have easily differentiated interior spaces.

Nor have prior art frameworks formed from simple structural modules making a great diversity of different geometric models, been able to achieve both rigid interior and exterior structures which were structurally integral to each other but each of discrete separate form, not being the same structural elements at the exterior and the interior of the polyhedrons.

(h) Other more traditional modular building systems of the prior art often utilize rectilinear building forms as the end product of the construction process, even if some triangulation is also used in the subassemblies used to achieve the final forms. These rectilinear forms are inherently not very rigid and therefore require additional stiffening which must be added to the rectilinear forms to achieve adequate rigidity.

OBJECT AND ADVANTAGES

Accordingly, besides the objects and advantages of the modules described in my above patent, several objects and advantages of embodiments of the present invention are;

(a) to provide a diverse number of very different structural frameworks, and to achieve this diversity using only a single discrete system of struts and connectors;

(b) to provide a simple and inexpensive traditional-type connector, however able to achieve a great diversity of newly taught non-traditional previously unknown concave polyhedral frameworks from a single simple structural system, having only a few different linear structural elements, and by varying the connectors' form various orientations of its structural members forming into a variety of different concave polyhedral forms:

(c) to provide a structural framework system made from known shapes of connectors and struts and existing methods of erection and construction which is nonetheless able to achieve a great diversity, complexity, and variety of previously unknown concave polyhedral structures;

(d) to provide a simple and inexpensive structural framework system which forms new, previously unknown useful geometric polyhedral frameworks;

(e) to provide a framework system with deep interior triangulated stiffening, able to achieve a great diversity of forms from a minimal inventory of parts, not being a thin shell or shallow framed single planar lightweight structure, but being discretely deeply stiffened at both its exterior and its interior by discrete structural members and therefore able to easily integrate traditional building subassemblies, for example floor systems and their attendant imposed structural loads, and to resist large imposed loads;

(f) to provide a framework system able to achieve great diversity of forms from a minimal inventory of parts, and still able to resist large imposed loads from both the exterior and the interior of the structures, being very practical frameworks;

(g) to provide a very simple structural modular element made from a few number of known parts, forming a diverse variey of new innovative complex polyhedral frameworks, able to resist large loads;

(h) to provide a modular building system in which all of the component parts of the geometric forming and rigidifying structure of the system are inherently triangulated, requiring little additional bracing to rigidify any larger structures or rectilinear structures made by the present invention, when compared to the prior art;

Further Objects and Advantages are;

to provide a rigid stellate wall-sized structural module formed from the joinder of multiple non-rectilinear polygonal walls used with others of like kind to form complex concave polyhedral structures having discrete interior and exterior structures, to provide a rigid structural modular element being a stellate-formed joinder of at least two non-rectilinear polygons which when repeatedly joined with others of like kind progressively builds up a complex concave polyhedron and thereby progressively increases the strength and complexity of the polyhedron forming a greater rigid framework, and to form by this method an entire family of different concave polyhedrons having discrete interiors and exteriors, to provide a modular element which is easy to manufacture, frameworks which are easy to erect, and which are capable of being disassembled and variously reconfigured by using different connectors, and which may provide a variety of different enclosed shapes of volumes from the same basic modular elements and family of simple connectors, to provide both uniform simple extendable arrays of geometric structures and very unique complex geometric frameworks, with different interior and exterior structural forms.

to provide several different faceted substantially cylindrical polyhedral frameworks with discrete interior radial bulkheads, to provide several different variations of substantially spherical polyhedral frameworks with discrete interior triangulation some formed of shallow spaceframe-like frameworks being shallow octohedrons and deltahedra; some with great-circle-like ridges formed from the edges of the polygons of the basic modules of the device of the present application extending about the exterior of the structure and having a substantially great depth of triangulated structural stiffening at the interior, to provide substantially rectilinear arrays formed of shallow spaceframe being shallow octohedral subassemblies joined both at their base edges and at the non base edges of the basic rigid stellate polygonal module, to provide several different umbrella-like or parasol-like frameworks having at the interior of the frameworks, central, faceted substantially cylindrical columns with discrete interior bulkheads supporting faceted lozenge-like or flattened spherical or other complex exterior roof forms and which may be extended so that several frameworks may be connected and extended to enclose space with complex polyhedron structures, to provide octohedral frameworks with additional six-faced deltahedra extending both to the interior and to the exterior of the structure about the base of the deltahedra at the faces of the octohedra and with smaller octohedra extending both to the interior and exterior of the structure located at the vertices of the octohedra and whose vertices when additionally differentiated through connection by a linear strut form a tetrakis hexahedron, to provide various spaceframe structures formed of multiple six-sided deltahedra joined at their base edges, to provide a space-filling eggcrate-like spaceframe structure containing many similar void spaces or a portion thereof used as a pitched roof truss formed of shallow octohedrons being a shallow spaceframe-like structure, the octahedrons joined at their base edges and at the surfaces and edges of the polygons of the rigid polygonal modules of the embodiments of the present invention, linear strut members located between the non-base vertices of the octahedrons as required to further stiffen the structure, to provide a space filling eggcrate-like spaceframe structure containing many similar void spaces and flexible through a variable radius of curvature of the whole structure made of shallow octohedrons joined at their base edges and at the surfaces and edges of the polygons of the rigid polygonal modules of the device of the present invention, linear strut members located between the non-base vertices of the octohedrons as required to further stiffen the structure, to provide three joined substantially cylindrical faceted structures with discrete interior bulkheads thereby forming an overall substantially triangular polyhedral framework of faceted cylindrical cross sections having a footing or foundation anchoring formed integrally at the corners of the substantial triangular framework made at the location of the axis of the base edge portion of the rigidly joined stellate polygons and thereby formed either with a depression or a void at the center of the three joined cylindrical structures, to provide several different extremely complex polyhedral structures being several joined intersecting substantially spherical faceted structures having some triangulation at their interiors and being formed substantially of shallow spaceframe structures which are shallow octohedrons and of deltahedrons, the intersection of the several spherical structures forming a complex manifold structure with tunnel regions formed from the proximity of three faceted substantially cylindrical connecting regions made of the rigid stellate polygons of the embodiments of the present invention, to provide a network of deltahedrons formed symmetrically across a planar mat which may be varied by differing the connectors at the bases of the deltahedrons and which forms several different faceted substantially cylindrical structures and in addition forms a structure being at its exterior a deep triakis-icosohedron and at its interior a great dodecahedron, to provide a research tool for the systematic testing of rigid non-rectilinear stellate-joined walls, which may be used to discover further additional new complex polyhedrons formed from the joining of several modules made of the stellate polygons of the embodiments of the present invention joined at various differing angles, also making additional hybrid combinations of the several complex polyhedrons of embodiments of the present invention, to provide additional linear strut members to further stiffen and rigidify the structures formed by the rigid stellate polygonal module of the device of the present invention, to provide a comprehensive structural system in which the constituent parts of the basic modules of the system are so simple that some of the elements of the many disparate complex framework structures which may be formed may be easily joined to each other through the abuttment of the substantially identical constituent parts and therefore allows for the formation of the joinder of the many different complex structures of the embodiments of the present invention thereby forming complex framework structures, Still further objects and advantages will become apparent from a consideration of the ensuing description and drawings.

DRAWINGS FIGURES

In the drawings, closely related figures have the same number but different alphabetic suffixes.

FIG. 1A shows a plan view of two joined polygons according to the invention.

FIGS. 1B to 1D show plan views of several typical embodiments of the basic rigid stellate module, with additinal connectors attached.

FIG. 2 shows a perspective view of one typical embodiment of the basic rigid stellate module with a second module attached.

FIG. 3 shows a perspective view of a portion of a basic rigid stellate module having two non-rectilinear polygons joined at their base edges by a connector located at each end of the axis of attachment which is parrallel to the base edges of the two polygons.

FIG. 4A–4C shows some typical non-rectilinear polygonal panels.

FIG. 5 shows a perspective view of a typical non-rectilinear polygonal according to the present invention having a three-way stellate connector at its base edge and a two-way stellate connector at one of its side edges.

REFERENCE NUMERALS IN DRAWINGS

Figure 6A:
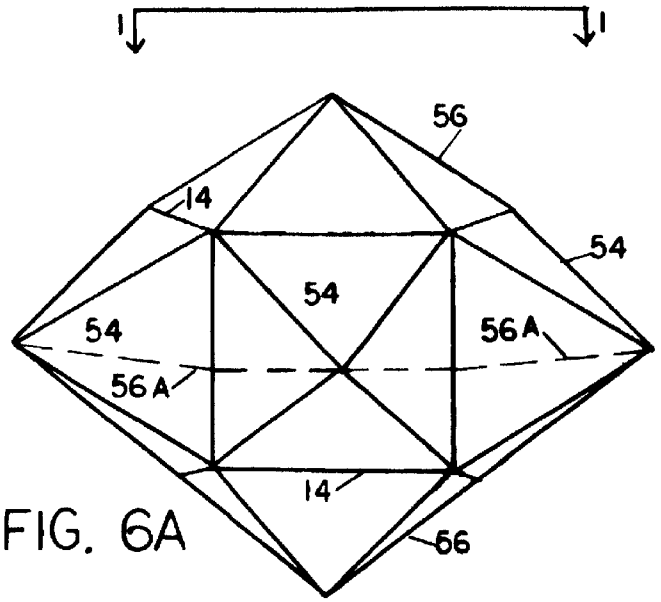
FIGS. 6A-6B show a basic complex polyhedral structure formed from embodiments of the present invention.

4 non-rectilinear polygon
4A additional polygon of additional stellate module
4B opening in polygon
5 end of base edge of non-rectilinear polygon
5A non-base (side) edge of polygon
6 connector at base edges of coincident stellate polygons
6A additional point connector at vertice of non-base (side) edges
6B additional point connector at middle of non-base (side) edge
6C continuous connector at base edges of coincident non-rectilinear polygons
6D additional continuous connector at additional polygon of additional stellate module
6E axis of rigid stellate joinder
7 angle of rigid stellate joinder
27A linear structural element
27B barrel segment
38 angle opposite stellate axis
40 line of truncated polygon
54 octohedrons
56 10-sided deltahedrons
56A strut
58 6-sided deltahedrons
60 depression
62 joinder of 2 cylinders
64 bulkhead
66 faceted column alternate
68A faceted column
68B faceted column
68C faceted column
70 bearing edge portion of joinder 62
72 central axis of cylinder, center of bulkhead
74 center top
76 equilateral triangle
78 non-eqilateral triangle
80 dimpled in
82 dimpled out
84 faceted column
86 void adjacent dimpled in
88 void adjacent dimpled out
90 shallow octohedron
92 planar spaceframe
94 parasol-like roof
96 faceted cylindrical structure
98 faceted cylindrical structure
100 stiffener
102 octahedrons
104 continuous faceted linear ridges
106 tetrahedral-like structure
108 substantially square surface
110 non-base edge
112 protrusion
114 substantially spherical structure
116 faceted cylinder
116A bulkhead
118 three-stellate module
120 four-stellate module
122 substantially spherical structure
124 manifold
126 faceted cylinder
128 faceted cylinder
130 egg crate like structure

DESCRIPTION FIGS. 1–18

In the instant application a generic teaching is disclosed, utilizing one simple modular rigid stellate structural element, which when combined with others of like kind, can yield a multitude of individual species of useful rigid geometric frameworks, forming a variety of engineering and architectural structures having discrete interior and exterior structures, all being easily clad using flat planar panels. In the instant application, several polygonal panels which may be frameworks or other structural devices are rigidly joined about an axis thereby forming a stellate, rigid structural module. In a preferred embodiment the sides of the three joined polygonal frameworks are made from struts of equal length, and several modules are combined to make a rigid polyhedral framework. In another preferred embodiment four joined polygonal frameworks having struts of not equal length form modules of which several are joined to make a rigid polyhedral framework. Therefore a rigid, stellate shaped and incompletely polyhedral module forms in conjuction with others of like kind a variety of rigid polyhedral frameworks. The teaching of the instant application discloses an incomplete polyhedral module, having a stellate or star-shaped form, made of non-rectilinear polygons stellately joined at their bases, wherein the non-base sides of the basic polygons are used to join several of the modules together thereby progressively building up the new polyhedrons of the teaching of the present invention. The varying of the angles of the several polygons of the basic module of the instant application in relation to each other by the use of differently formed connector holding in place the polygons at different angles in relation to each other, creates differing arrays of groupings of the basic stellate modules, thereby forming a new family of rigid complex polyhedrons.

FIG. 1A shows a plan view of two joined polygons according to the invention.

FIGS. 1B to 1D show plan views of several typical embodiments of the basic rigid stellate module.

FIG. 2 shows a perspective view of one typical embodiment of the basic rigid stellate module, with a second module attached.

FIG. 3 shows a perspective view of a rigid stellate module with two non-rectilinear polygons attached at coincident edges.

FIGS. 4A–4C shows some typical non-rectilinear polygons from the present invention.

Figure 6B:
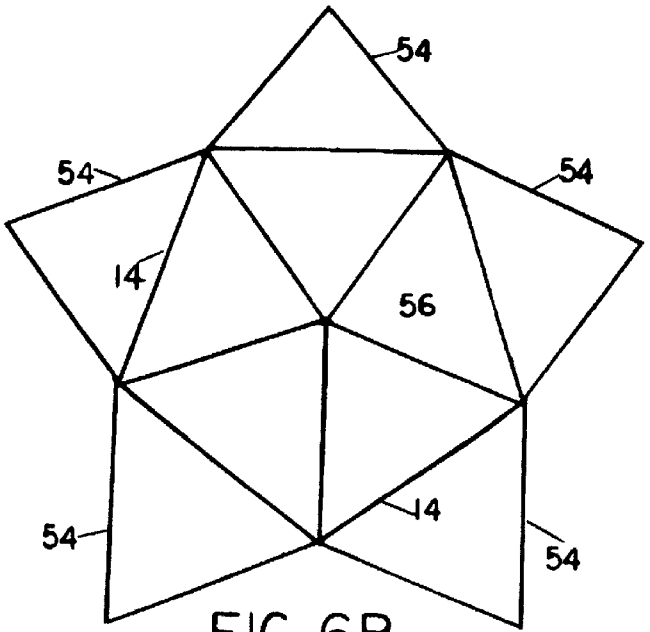
Figure 6C:
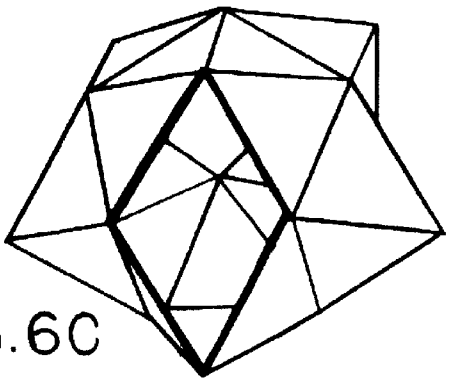
FIG. 6C shows a cut-away view of a part of the interior of the structure of 6A and 6B.

FIGS. 6A-6B shows a basic polyhedron formed from embodiments of the present invention, being the joinder of five octahedrons 54, to two ten-sided deltahedrons 56, such that the discrete geometric forms at the exterior of the polyhedrons are the inverse of the additional discrete geometric forms at the interior of the polyhedron. The inverse at the interior is shown in FIG. 6C. This is a typical feature of the teaching of the present invention, in that several of the structures of the present invention have an interior which is either the exact inverse of the exterior form or a substantially identical reverse of the exterior forms. In some cases the interior edges of the inverse forms all meet at one point such as in the interior shown in FIGS. 6C, 7B, forming structures of complete triangulation which have extreme rigidity and strength. In some other cases the inverse edges do not all meet at a point, still forming useful structures of great strength, which may be additionally stiffened with additional linear struts. This basic polyhedron of FIGS. 6A and 6B is formed of the basic module of the present invention having three equilateral triangular polygonal panels joined about a rigid connector. A further variation, 56A at the perimeter of this polyhedron between the apices of the exterior projections of the octohedrons yields a modified structure having the same number of sides as the original polyhedron. This polyhedron, 6A, 6B has two preferred embodiments. In the first, when all edges of the polygons from which the rigid stellate module is formed are equal, the polyhedron formed will have 30 sides at its exterior, 30 at the interior, and at the interior all edges meeting at a single point, as in FIG. 6A, 6B. A second embodiment polyhedron is formed of rigid stellate modules having other types of polygons with non-equal edges thereby having thirty sides at each the exterior and the interior, but all edges at the interior do not meet at a single point. Such a structure may also be additionally stiffened with linear struts. FIG. 6A is a perspective side view of this basic polyhedron looking towards one apex of one of the octohedrons at the exterior of the polyhedron. FIG. 6B is a top plan view taken along line 1—1 in FIG. 6A. FIG. 6C shows the interior of the structure of 6A showing all of the linear edges of the polygons meeting at a single point.

Figure 7A:
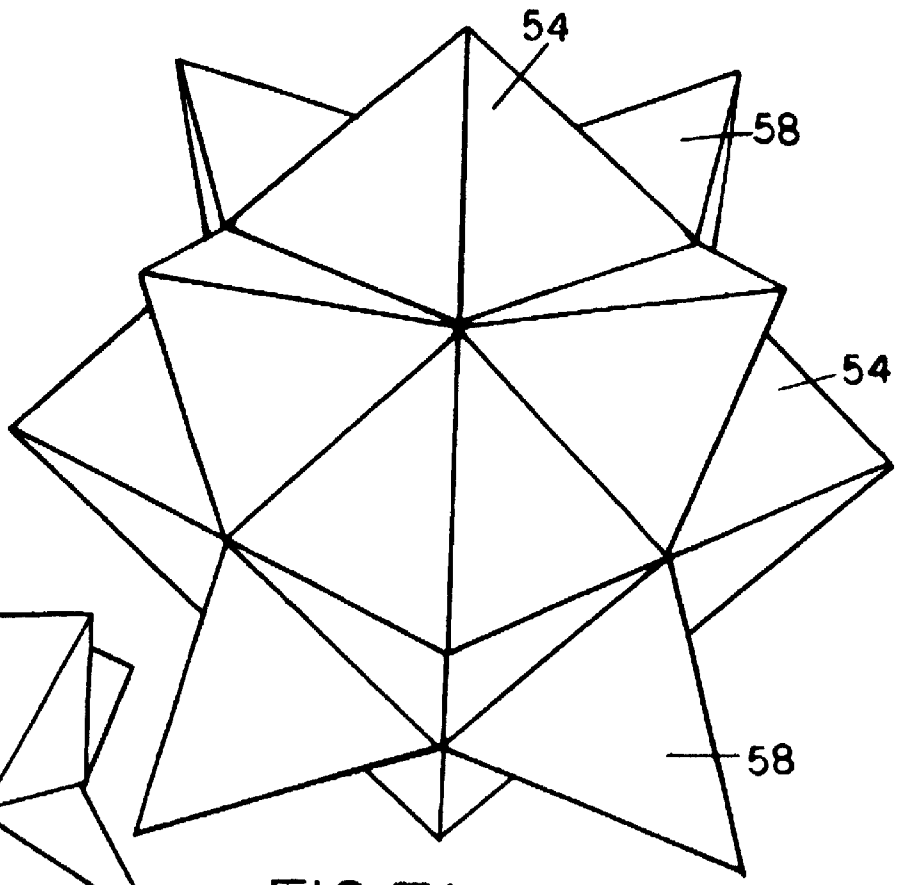
FIG. 7A shows an additional basic complex polyhedral structure formed from embodiments of the present invention.

FIG. 7A shows another basic polyhedron formed from the teaching of the present invention, being the joinder of six octahedrons 54, and eight, six-sided deltahedrons 58, such that the discrete geometric forms at the exterior of the polyhedrons are the inverse of the additional discrete geometric forms at the interior of the polyhedron. This polyhedron is a 48-sided concave deltahedron at its exterior. All edges of the structures at the interior of the polyhedron substantially meet at a single point. This polyhedron is formed entirely of the basic rigid stellate module of the present invention having three polygonal panels formed of equilateral triangles stellately joined about their base edges. The overall form of this polyhedron as formed by the adjacency of the base corners of the octohedrons at the exterior is a larger octohedron with additional tetrahedrons located at the center of the faces of the exterior triangular sides of the octahedron. A further truncation of this polyhedron yields a tetrakis hexahedron. This feature is similar to the device of FIGS. 14A & 14B later described, having a further truncation of their exterior yielding an icosohedron from a triakis icosohedron having a great dodecahedron at its interior.

The 48-sided polyhedron FIG. 7A may be used at the interior of other structures according to the present invention for example the faceted columnar structure 17.

Figure 7B:
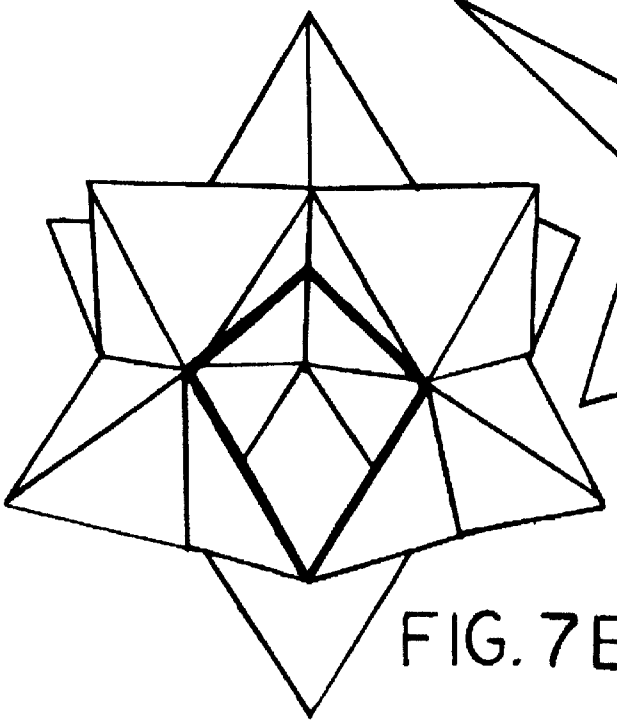
FIG. 7B shows a cut-away view of a part of the interior of the structure of 7A.

FIG. 7B shows the interior of the structure of FIG. 7A, showing all of the linear edges of the polygons meeting at a single point.

Figure 8A:
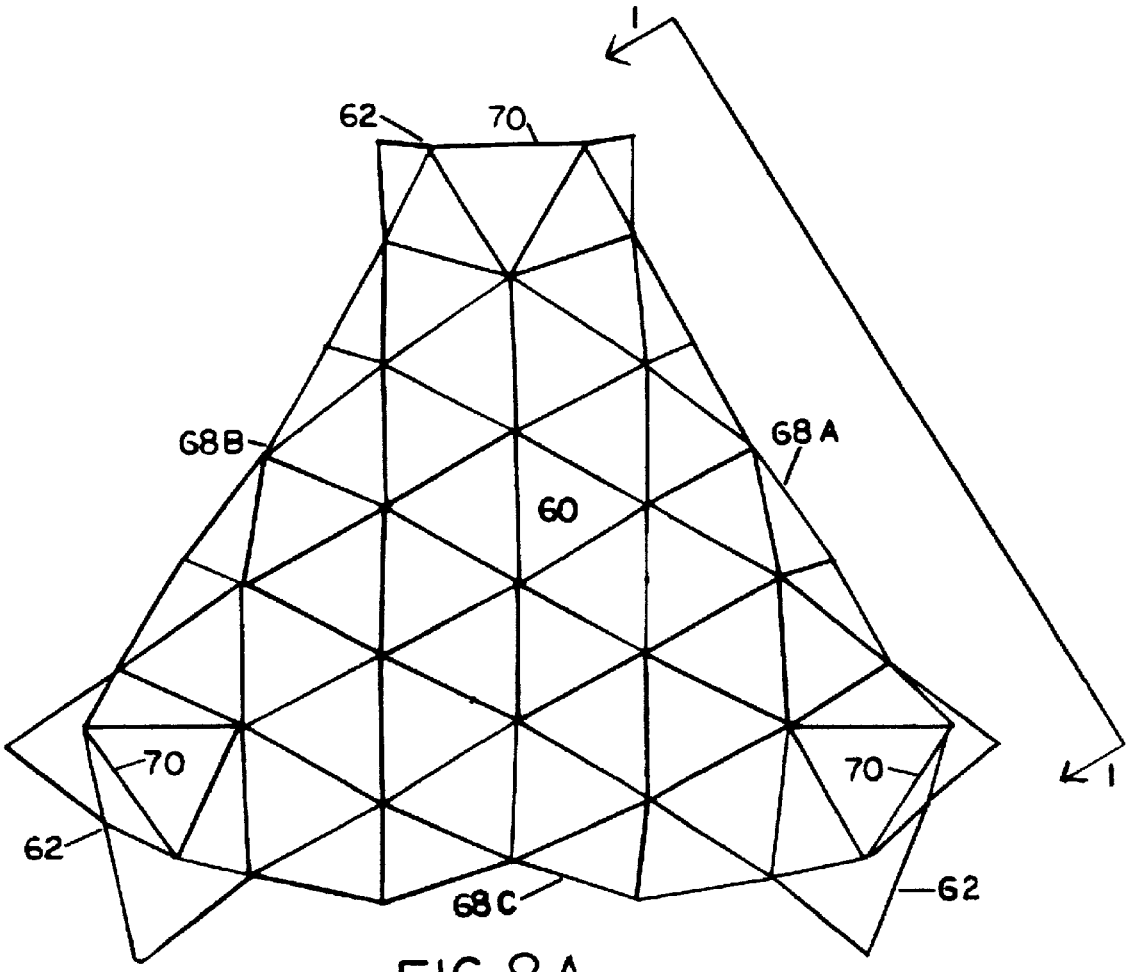
FIGS. 8A–8C shows a complex polyhedral structure being the joinder of three faceted cylindrical structural frameworks.

FIG. 8A is a top plan view of complex structure according to embodiments of the present invention. This structure is formed of the joinder of three faceted cylindrical columnar structures 68A, 68B, 68C. Faceted cylindrical columnar structures are one of the recurring forms of embodiments of the present inventions and will occur in several different structures according to the instant application. A depression 60, naturally occurs at the center of this structure where the three cylinders abutt each other.

Figure 8B:
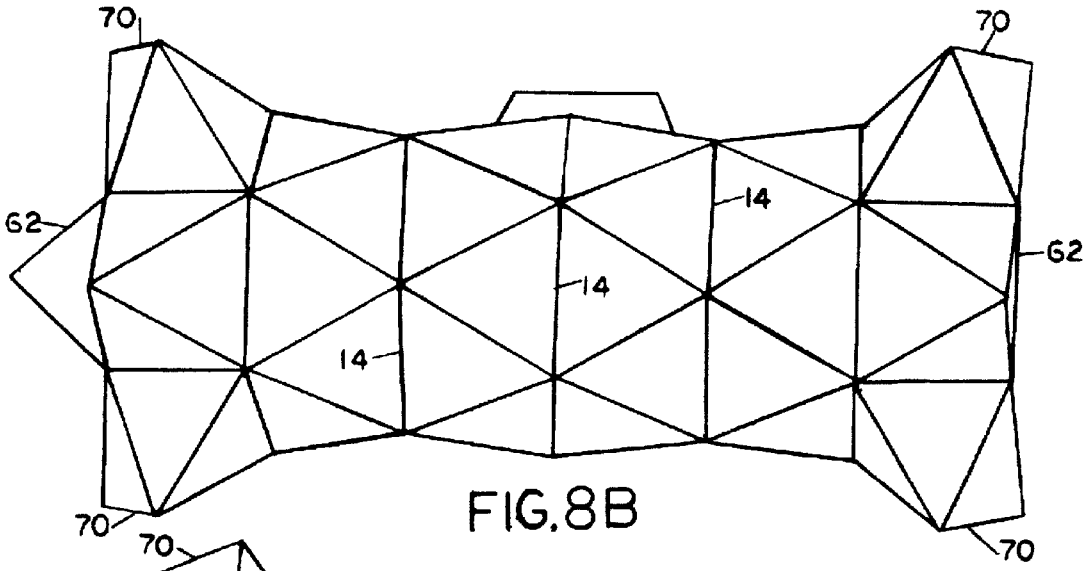
Figure 8C:
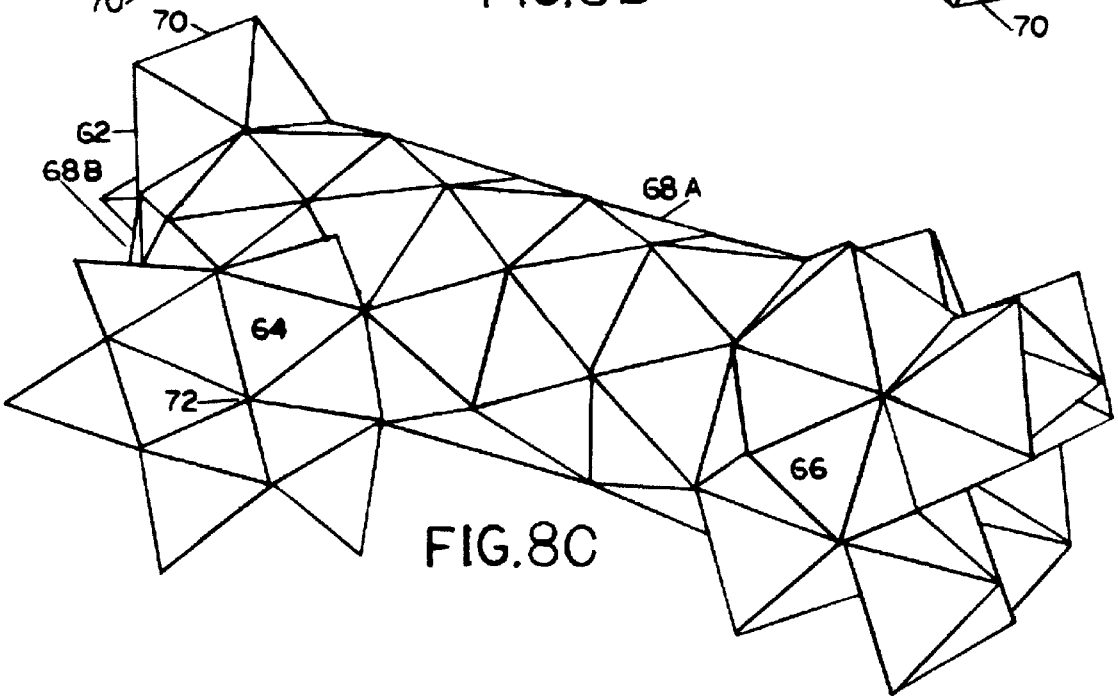

FIG. 8B is a perspective side view taken along line 1—1 in FIG. 8A. The connection at the comers of the joinder of the three faceted cylinders is shown at 62. The bulkheads 64 at the interior of the cylinders, which are formed of initial polygons according to embodiments of the present invention, are shown in FIG. 8C, which is a perspective partial section of the structure of FIG. 8A, showing one faceted cylinder 68A, a portion of an additional adjacent connected cylinder 68B with its interior bulkhead 64 exposed, and instead of the standard joinder 62 of two cylinders, an alternate form of the faceted columnar structure 66 is shown. The faceted cylindrical structures are stiffened at their interiors by multiple bulkhead structures 64 at the interior of the structure located normal to the central axis 72 of the faceted cylinder at each of the several axes 6E of the basic stellate modules. Each of the joinder structures 62 has an edge 70 which is oriented in a plane parallel to the central axis 72 of the three faceted cylinders, a point of which axis can be seen at the central point 72 of the bulkhead 64. This allows the useful feature of providing the edge 70 to be a bearing surface for the entire structure 8A, and in addition allows multiple structures 8A to be stacked on top of another abutted and joined at edges 70, and also keeps the exterior surfaces of the faceted cylinders of structure 8A away from the bearing edges 70, thus creating an additional space between the structure and its bearing ground or an adjacent joined similar structure. The structure of FIG. 8A is formed entirely from the initial polygons being equilateral triangles joined in a three-stellate module. At each bearing edge 70 however, one polygon of the three-stellate module is removed. If the length of the faceted cylinders 68A, 68B, and 68C is increased, the depression 60 at the center of the structure will become a void space being the empty space formed between the three adjacent faceted cylinders. The greater the length of the cylinders so formed, the larger the void space will consequently become.

Figure 9A:
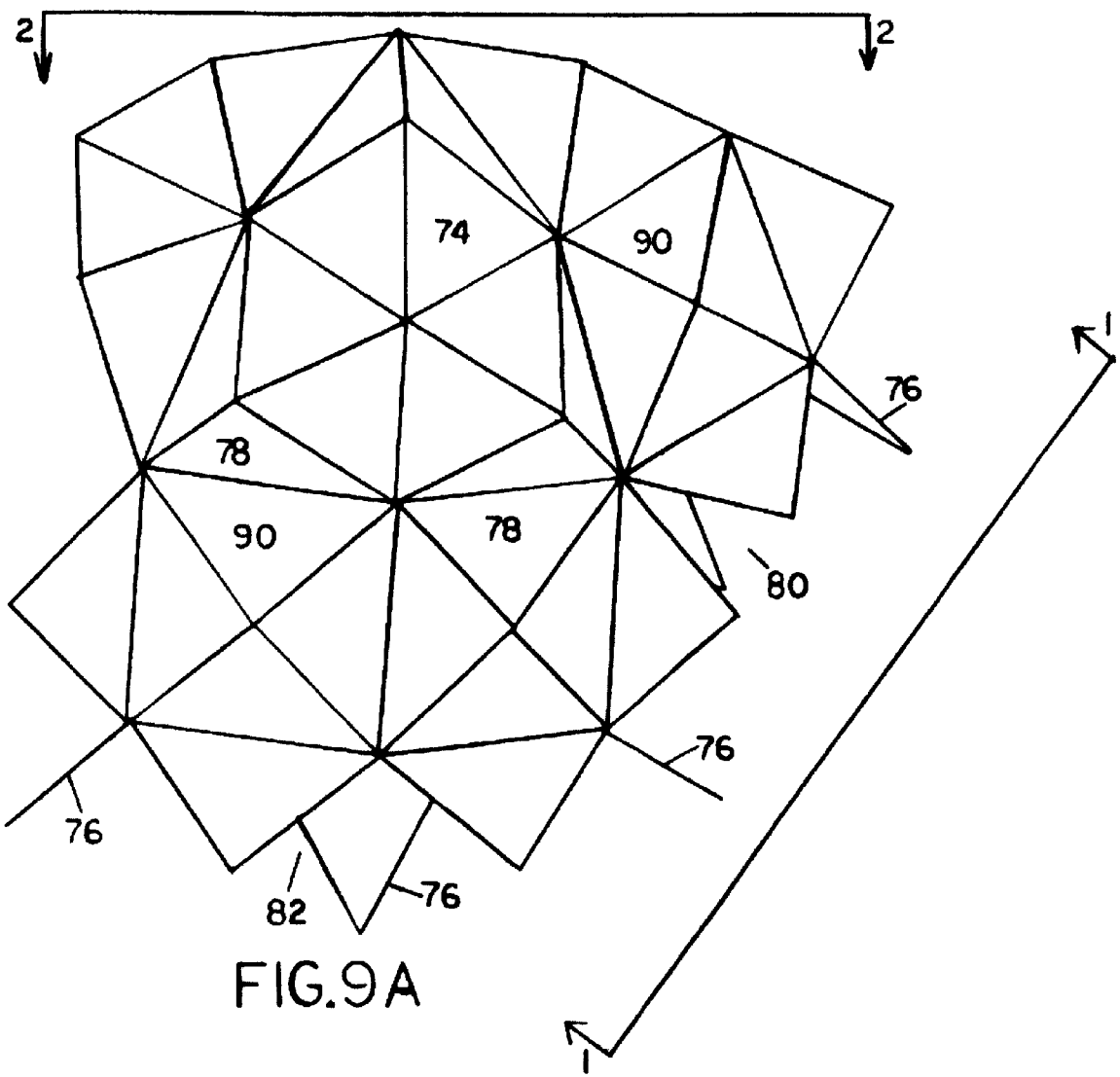
FIGS. 9A–9C shows a complex polyhedral structure having a faceted columnar cylindrical structure at its center and additional frameworks located at the ends of the axis of the column and continuing out away from the center column.
Figure 9B:
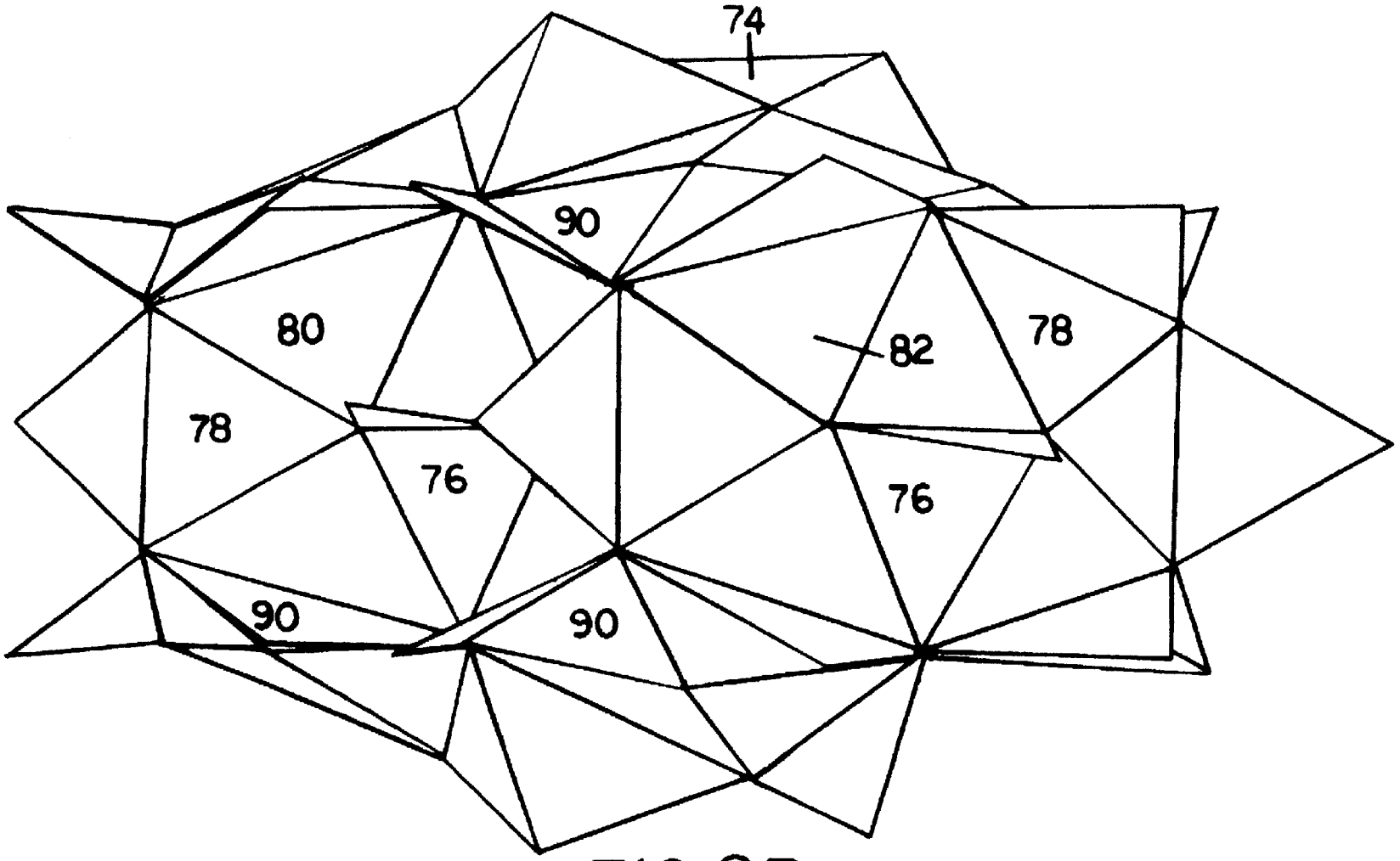

FIG. 9A shows a top plan view of a portion of an exterior of a complex structure according to the present invention. The center of the top of the structure 74 is formed of a concave shape made of 6 equilateral triangles being visible portions of three stellate modules according to the teaching of the present invention. Spreading out from the center of structure 9A are attached additional stellate modules according to the present invention, made from initial polygons being both equilateral triangles 76, and non-equilateral triangles 78. On the exterior of the structure shallow octohedral forms 90 are shown which form a part of the faceted, complex, substantially partially spherical exterior of the structure. FIG. 9B is a perspective side view taken along line 1—1 in FIG. 9A. This polyhedron is very complex in shape having several alternate forms, one of which is shown in 9B. In the preferred embodiment shown in FIG. 9B, two partially enclosed spaces 80 & 82 are shown. One of these enclosed spaces 80 is dimpled inwardly towards the interior of the structure and the other 82 is dimpled outward toward the exterior of the structure. These two enclosed spaces are at their shown perimeters formed of the same initial polygons and both are comprised of identical stellate modules according to embodiments of the present invention. A total of 6 such enclosed spaces are located about the top central portion 74 of the structure, only two of which are shown in view 9B. These 6 enclosed spaces complete a first layer of enclosure at the exterior of the structure shown in 9B. Additional different enclosed spaces formed of the basic stellate modules may continue to add on to the perimeter variously completing the structure of FIG. 9A. FIG. 9B therefore shows one exterior layer of a structure formed of embodiments of the present invention. This complex polyhedron is formed from stellate modules made from both equilateral triangular and non-equilateral triangular polygons. The opposite discret interior side of the shallow octahedral structures 90 and the structure 74 are located at the interior of the structure of FIG. 9A are shown in FIG. 9B.

Figure 9C:
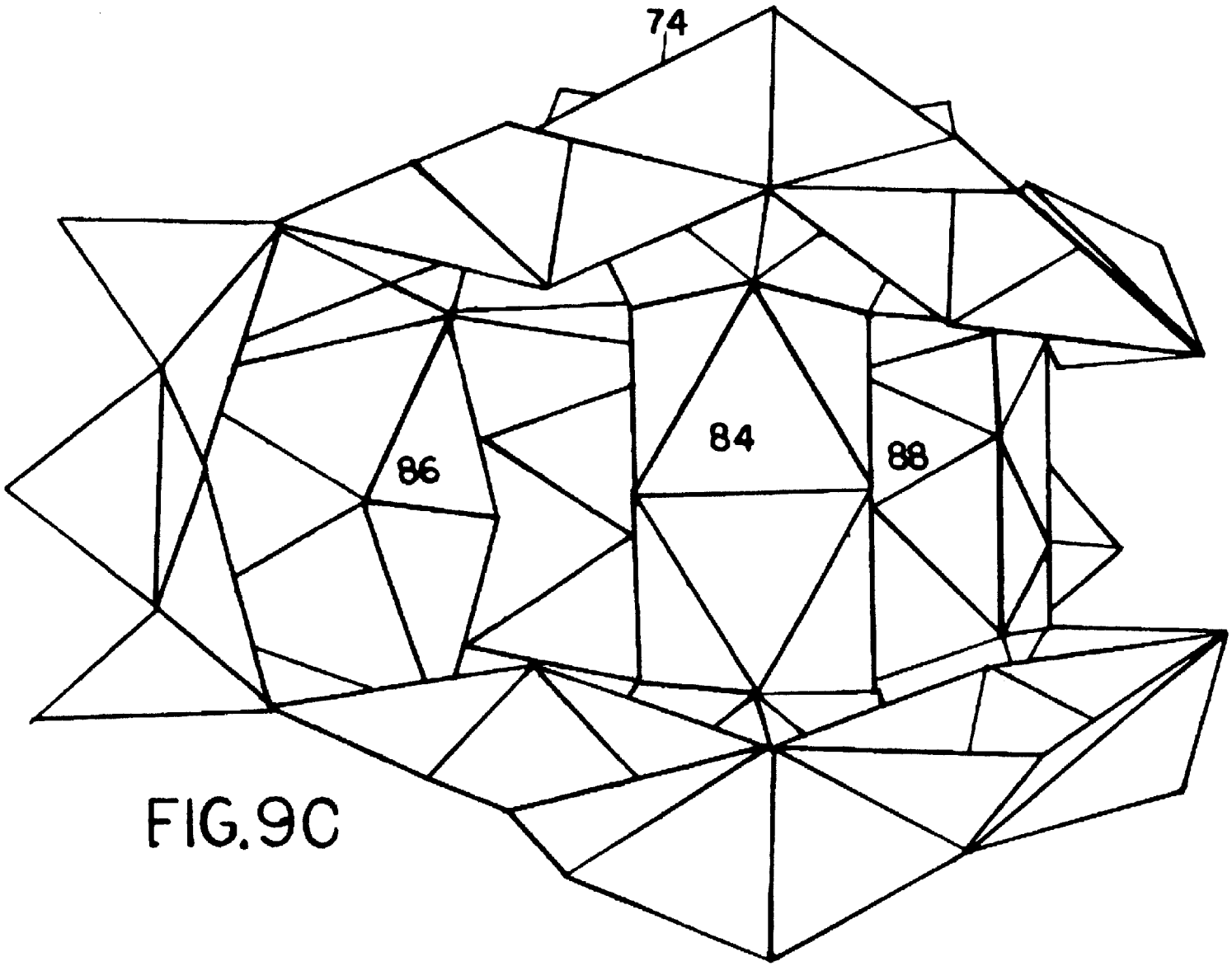

These shallow octohedral structures are made from non-equilateral triangular polygons and are an element which occur in many of the different structures according to the present invention. FIG. 9C is a perspective side view taken along line 2—2 in FIG. 9A. FIG. 9C shows the interior of the complex polyhedron. At the interior of this polyhedron is a faceted columnar structure 84 which connects to the underside of the top central form 74. The faceted column 84 connects at each of its ends to a similar structure 74, thereby making a symmetrical structure. The form of the structure of FIG. 9C shows a column structure 84 connecting to a top structure 74 which spreads out to complete the entire structure in a form which is parasol-like. A faceted interior column structure attached to a faceted partially spherical parasol-like exterior structure is a geometric form which appears in several different embodiments as shown below in the present invention. In FIG. 9C the interior of the structure shows several void spaces or rooms which are located behind and adjacent the dimpled void spaces abovementioned, and are formed of the inverse geometries of the exteriror forms shown in FIGS. 9A and 9B. The inward dimpled space 80 has the interior void space 86 located adjacent to it. The outward dimpled space 82 has the interior void space 88 located adjacent to it.

Figure 10A:
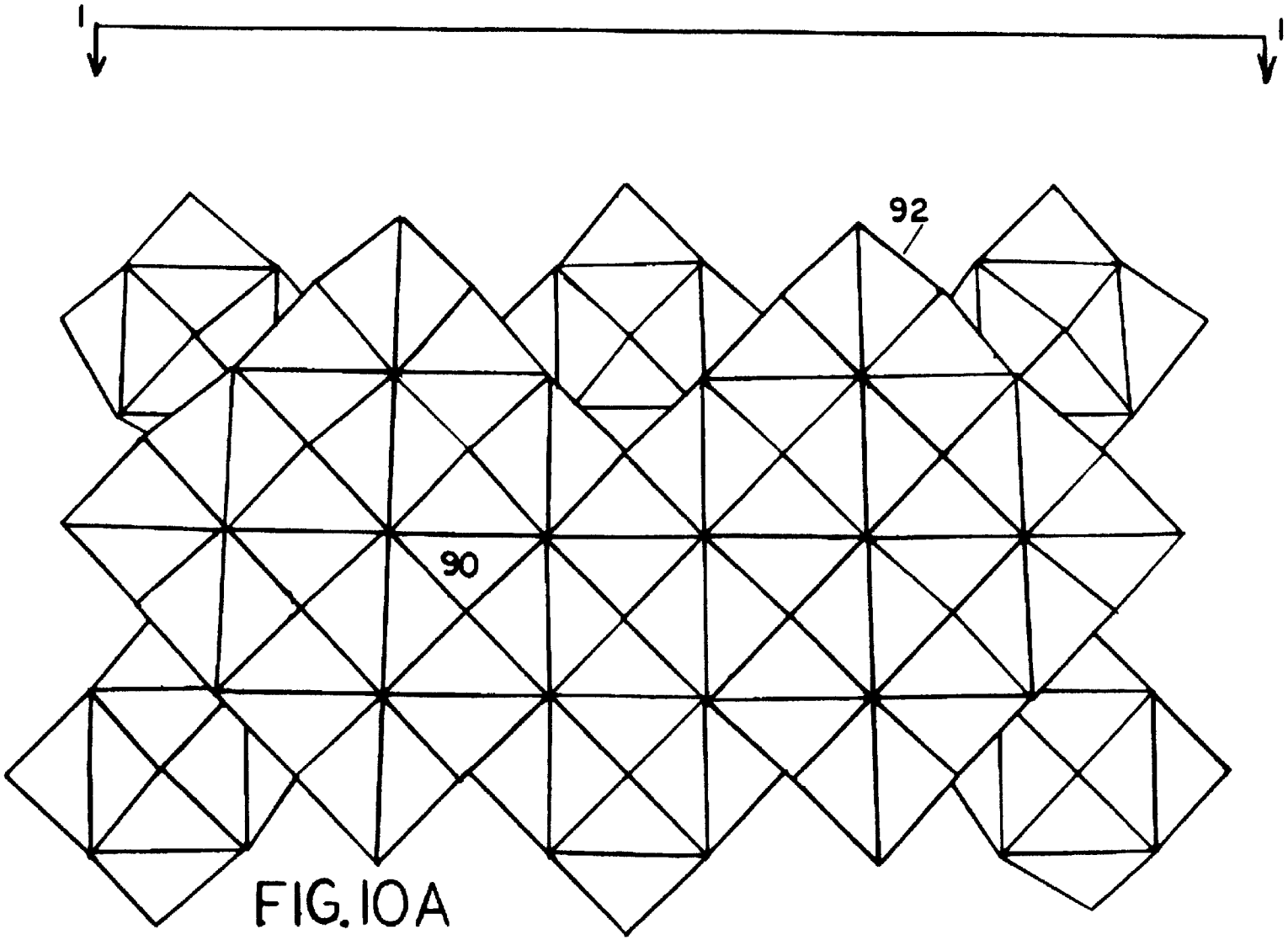
FIGS. 10A-10B show a complex structure formed of a joining of several parallel layers of shallow octahedral frameworks.
Figure 10B:
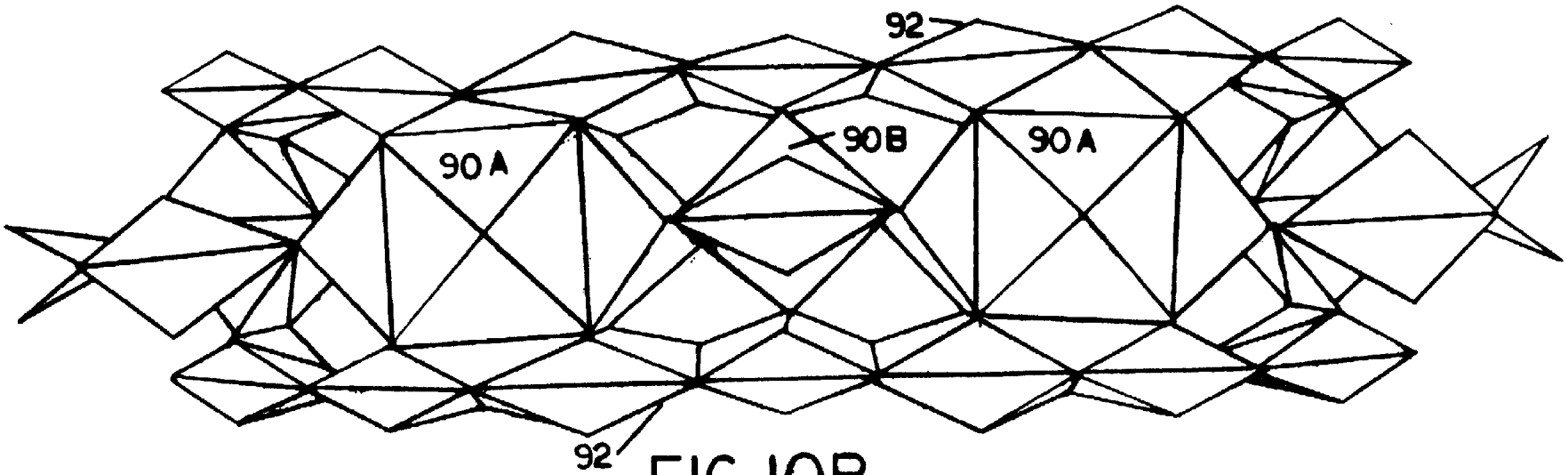

FIG. 10A shows a top plan view of a structure according to the present invention made entirely of modules formed of 4-stellate non-equilateral triangular polygons joined about a rigid stellate axis. These modules form multiple shallow octohedrons 90 which are joined together to form a planar spaceframe structure. FIG. 10B is a perspective side view taken along line 1—1 in FIG. 10A. Two planar spaceframe structures 92 are joined together by additional shallow octahedrons 90A, 90B, some oriented normal, 90A, to the planar spaceframes, some oriented parallel 90B, to the plane of the spaceframe, to form the space enclosure shown in FIGS. 10A and 10B. Eight shallow octohedrons alternating in their orientations to the planar spaceframes 92, being alternately normal 90A and parallel 90B to the plane of the spaceframe, form a ring which is located between the two parallel spaceframes 92.

Figure 11A:
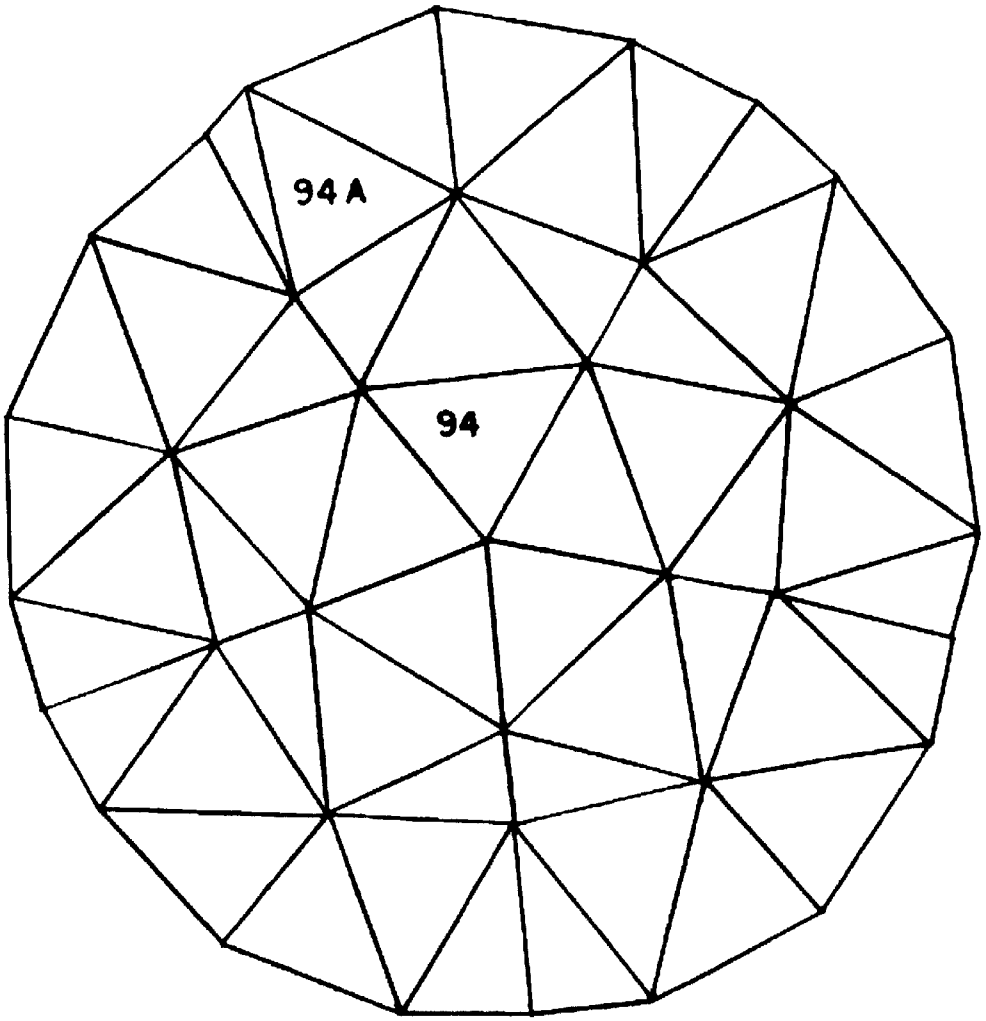
FIGS. 11A–11F show various forms of complex polyhedral frameworks having faceted columnar substantially cylindrical structures at their interior central axes and umbrella parasol-like structures formed at the ends of the axes, as well as hybrid versions of these structures.

FIG. 11A is a exterior top plan view showing a structure according to the present invention having a central area 94 formed of 5 basic 3-stellate modules according to the instant application using equilateral triangular polygons. As the structure spreads out from the top center, additional similar modules 94A are added to continue the structure, thereby forming a faceted substantially parasol-like form at the top of the structure.

Figure 11B:
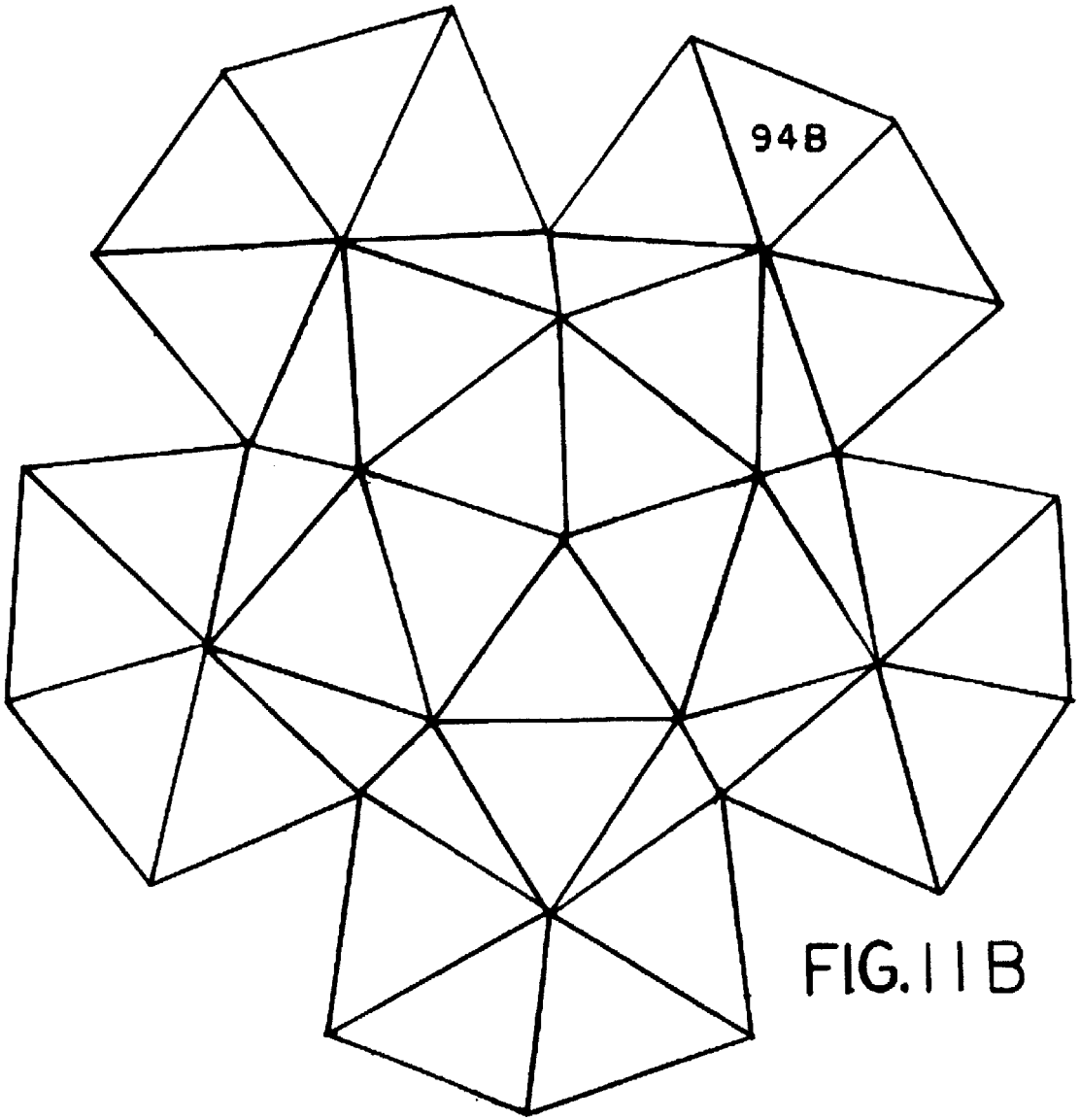

FIG. 11B is a structure similar to that of 11A, but terminating at its top perimeter in a different array with similar modules 94B turned at an angle to the previous layer of modules.

Figure 11C:
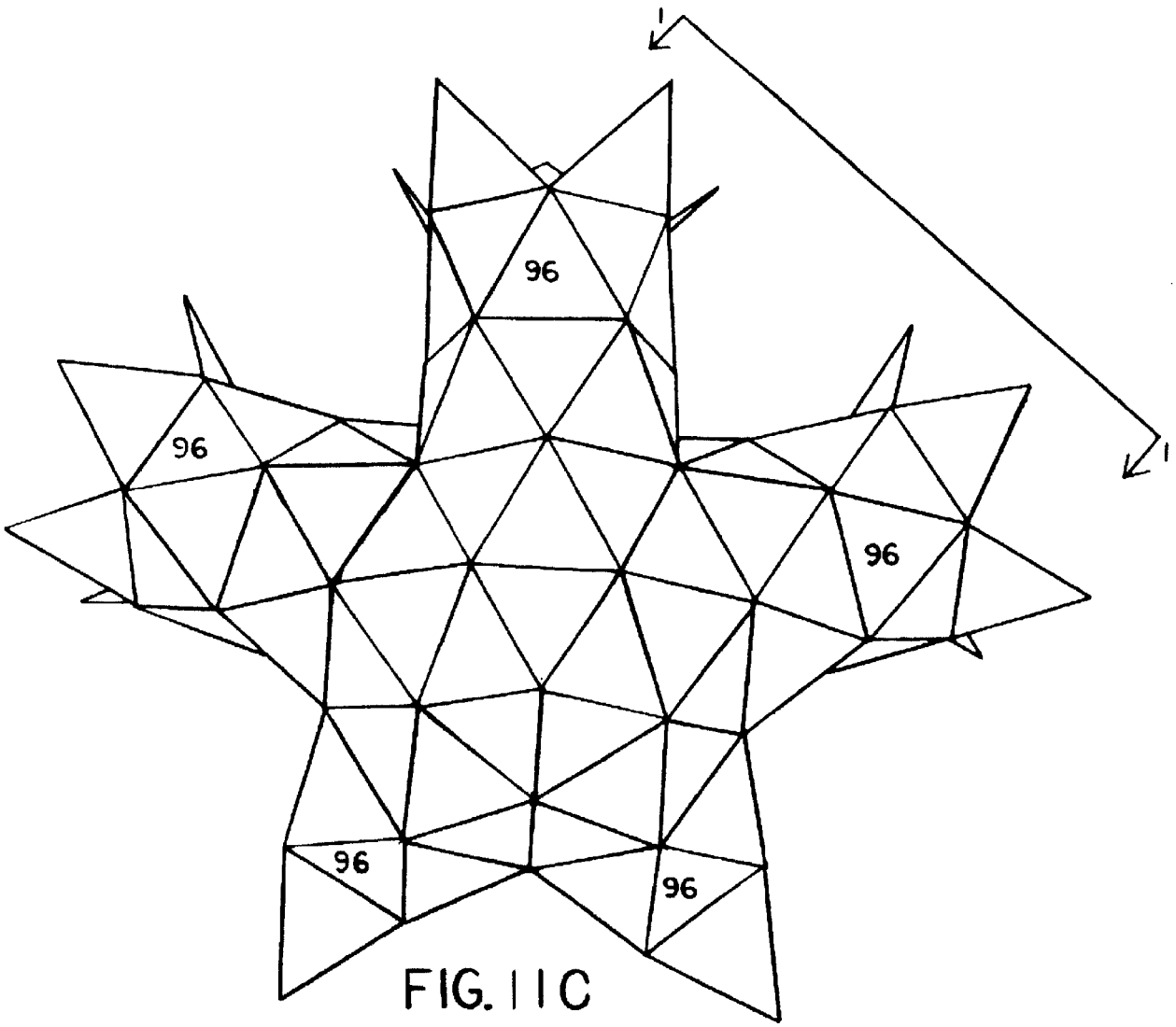

FIG. 11C is a top view perspective exterior plan similar to the structures of FIGS. 11A and 11B, however 5 additional faceted cylindrical structures 96 are formed attached about the top center parasol-like structure forming a complex structure according to the present invention.

Figure 11D:
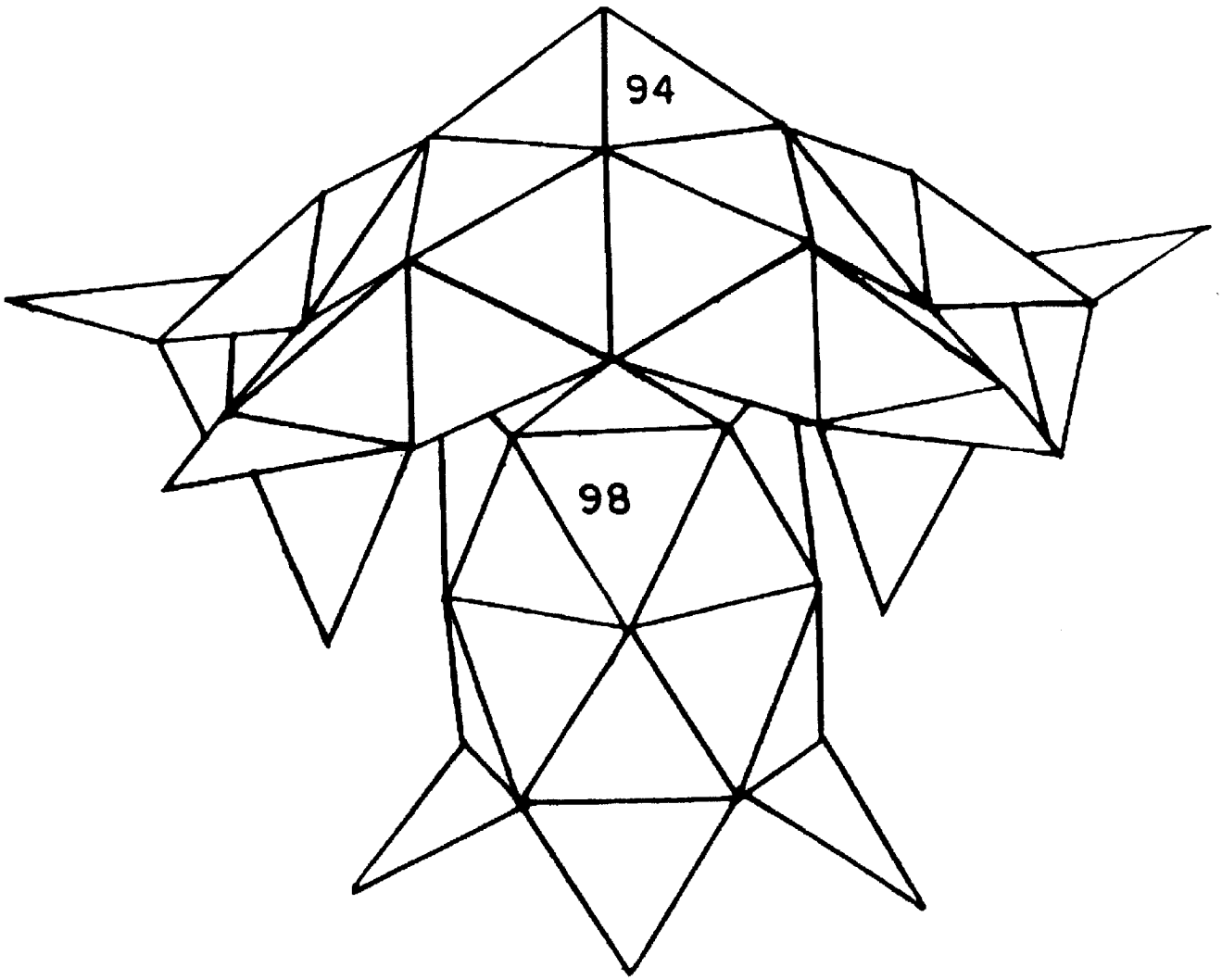

FIG. 11D is a side perspective view taken along line 1—1 in FIG. 11C showing a portion of the interior of the structure. A central faceted columnar structure 98, having interior bulkheads radially formed by adjacent abutted polygons of the instant application is shown connected to the interior underside of the top central area 94 to complete a parasol-like structure, wherein the roof of the parasol is the top central area 94 and its surrounding structures, and the central column of the parasol-like structure is the faceted column 98.

Figure 11E:
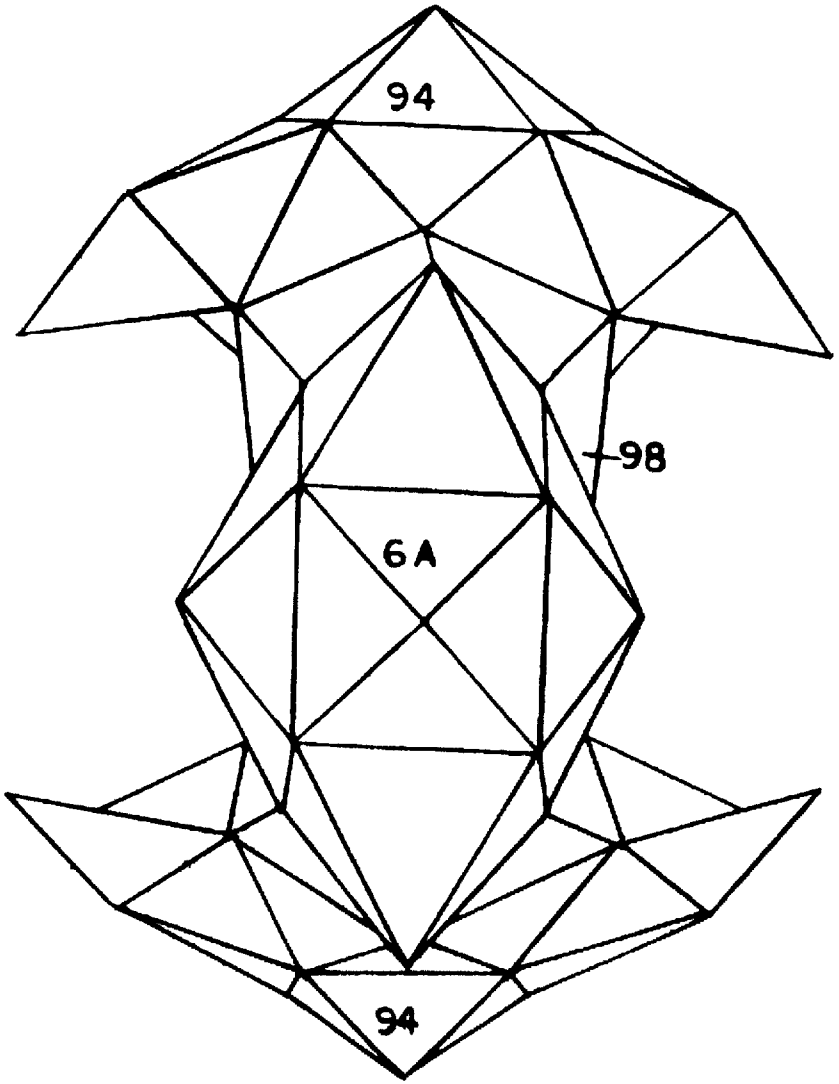

FIG. 11E is a similar structure to 11D with a top center parasol roof-like structure 94 formed at each end of the central faceted columnar structure 98. An additional structure similar to FIG. 6A is shown joined to the structure of FIG. 11E.

Figure 11F:
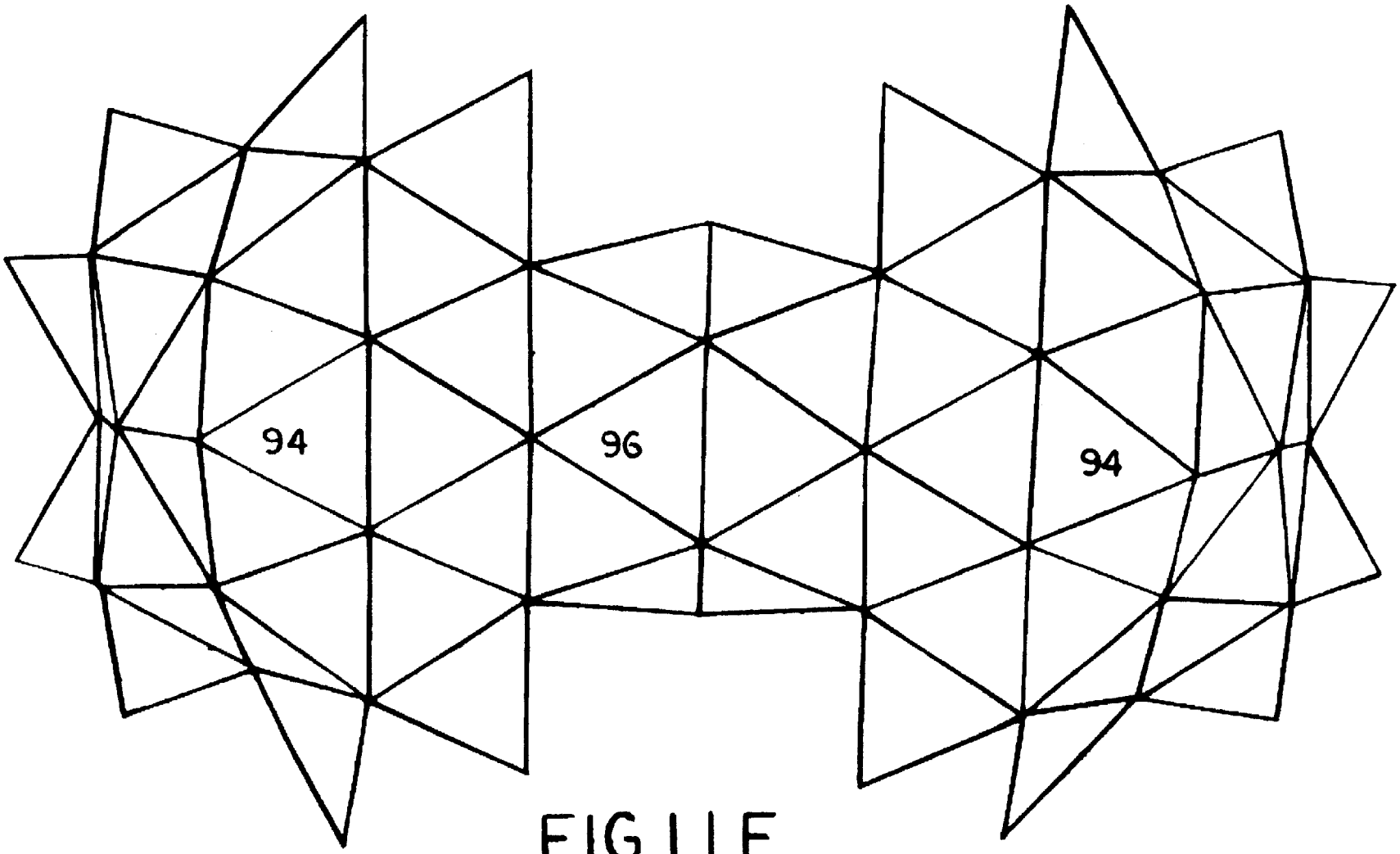

FIG. 11F is a structure showing the joinder of 2 structures similar to the structures of FIG. 11A, joined so that two top center areas 94 are located substantially adjacent to each other by a portion of a faceted cylindrical structure 96.

Figure 12A:
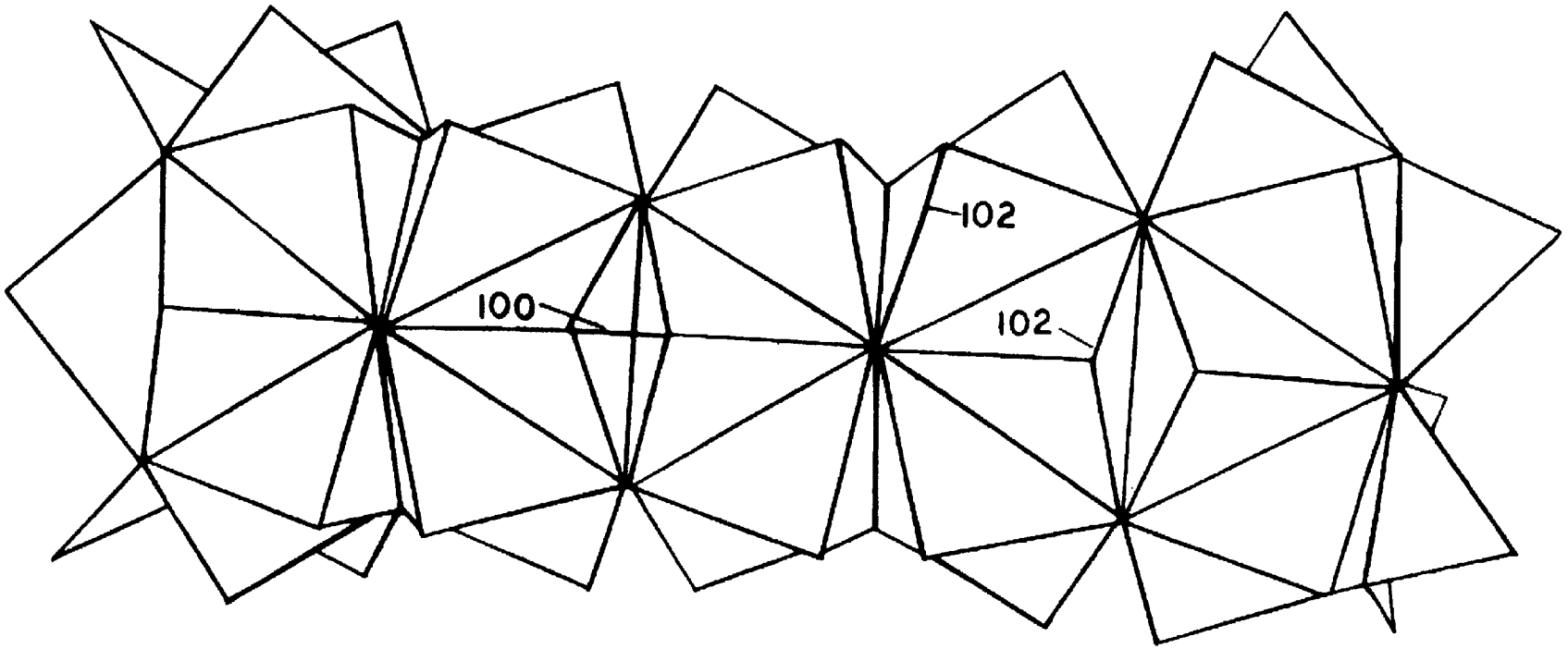
FIGS. 12A–12C show both complex faceted columnar structures and a variable polyhedral framework which are formed from deltahedra made from the basic modules of the embodiments of the present invention.

FIG. 12A is an exterior perspective view of a faceted cylindrical structure according to the present invention. The structure is formed entirely of 4-stellate modules using non-equilateral triangular polygons. Additional stiffening members 100 may be added to strengthen the structure. The form of the structure is that of multiple adjacent tetrahedrons. The interior of the structure is the inverse of the exterior, having identical edges and sides but reversed inwardly, so that the exterior exposes one half of the tetrahedrons of the structure, being the exposed tetrahedrons 102, and the interior being the inversed remaining half of the tetrahedrons, thereby tetrahedral forms being at the interior of the structure 12A.

Figure 12B:
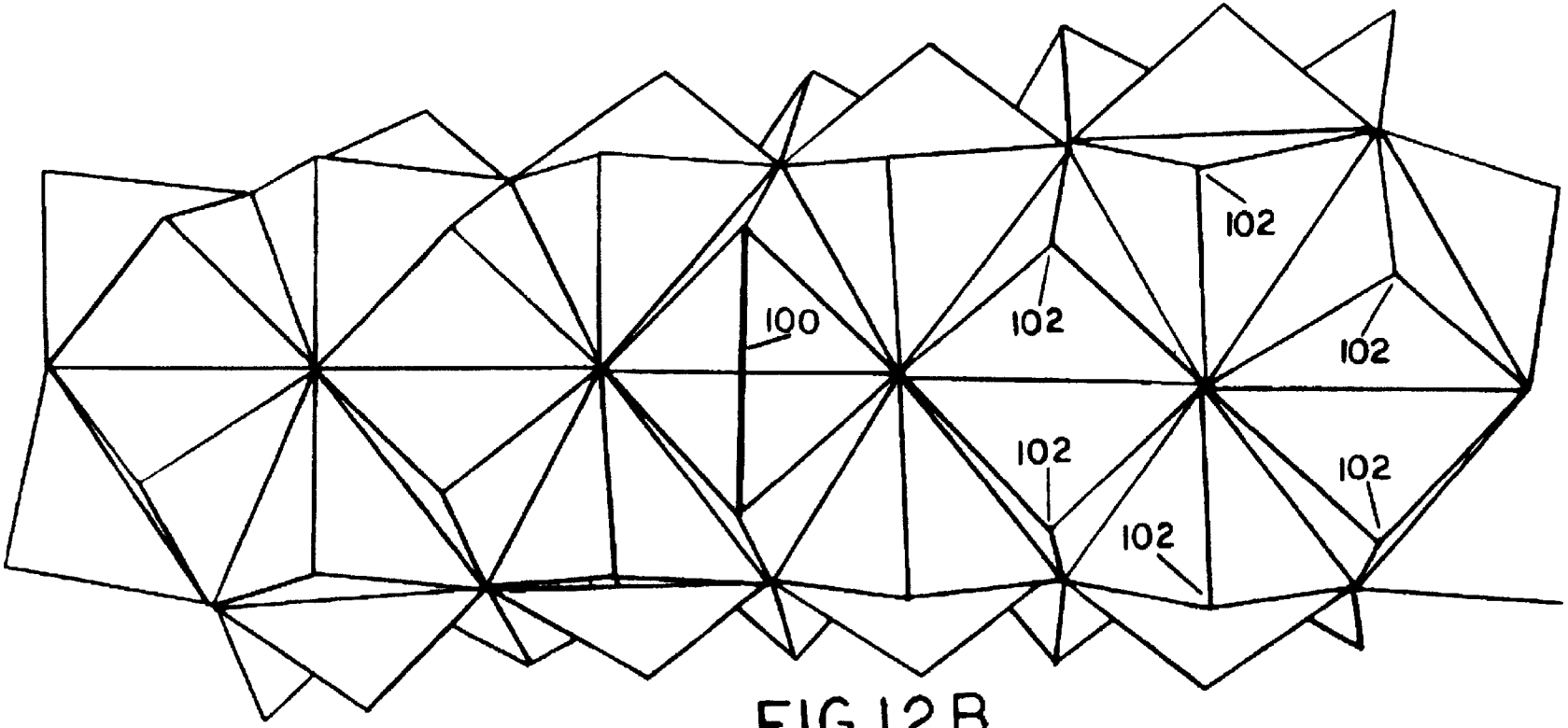

FIG. 12B is an additional faceted substantially cylindrical structure according to the present invention.

FIG. 12B is a perspective view of a faceted substantially cylindrical structure according to the present invention. The structure is similar to the structure of FIG. 12A, but having a different array pattern of the initial 4-stellate modules used to form the structure. Additional stiffeners 100 may be added as required.

Figure 12C:
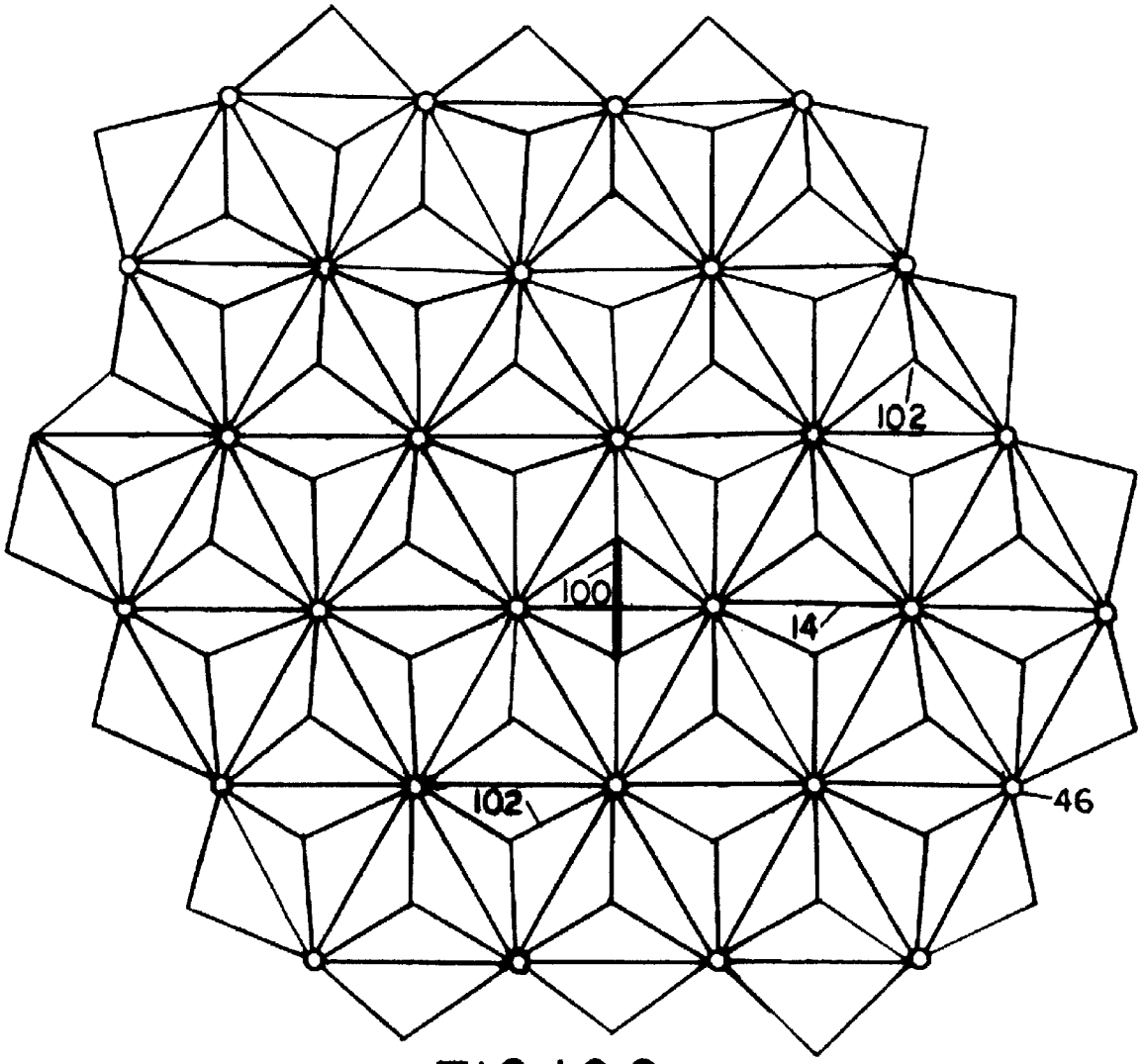

FIG. 12C is a planar space frame-like structure according to an embodiment of the present invention. It is formed entirely of 4-stellate modules made of non-equilateral triangles. Additional stiffeners 100 may be added as required. It is formed of multiple adjacent joined tetrahedral forms 102 similar to the structure of FIG. 12B, so that at the exterior of the structure a tetrahedral form is shown and at the interior of the structure the opposite inversed geometry is formed being a tetrahedral form. The devices of FIGS. 12A, 12B, and 12C are all formed from the same indentical basic modules. The geometric array of the forms of FIG. 12B is different than the array of FIGS. 12A and 12C, such that the distances between the several adjacent different tetrahedrons is varied.

FIG. 12C is a top plan view of a substantially planar space frame structure according to an embodiment of the present invention. It is formed entirely of 4-stellate modules made from non-equilateral triangular polygons. It is identical in structure on each side of its plane of symmetry. It is formed of adjacent tetrahedral structures joined across a plane of symmetry into six-sided deltahedral structures which are joined at their base edges. This is the form of the applicants issued U.S. Pat. No. 4,864,796 issued Sep. 12, 1989.

The joinder of several adjacent tetrahedrons along their base edge may be accomplished by a continuous connection 6C at the base edges of the joined polygons or may be accomplished by the point connections 6A, 6B.

Figure 13A:
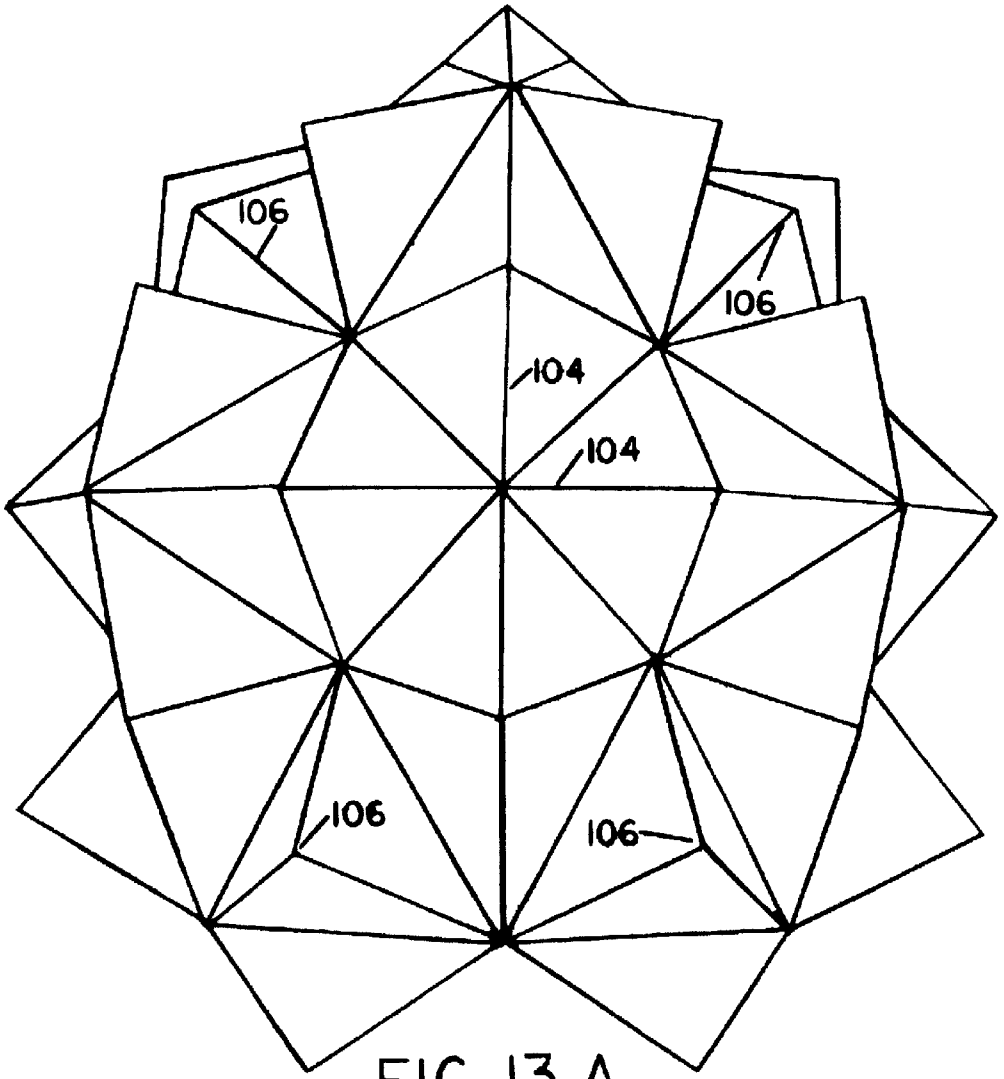
FIGS. 13A–13C shows a view of a complex substantially spherical framework formed of the joinder of shallow octohedra and deltahedra made from the basic modules of embodiments of the present invention, as well as one variation of the framework.

FIG. 13A is an exterior perspective view of a structure according to an embodiment of the present invention having a complex form being a substantially faceted spherical structure formed entirely of 4-stellate rigid modules according to embodiments of the present invention made from non-equilateral triangular polygons. The structure has some areas formed into tetrahedral-like structures 106, and some areas where continuous linear faceted ridges run along the exterior of the structure 104, having polygons adjacent to them along their length. The structure of FIG. 13A is deeply trussed by its particular geometry and is extremely rigid and resistant to loading.

Figure 13B:
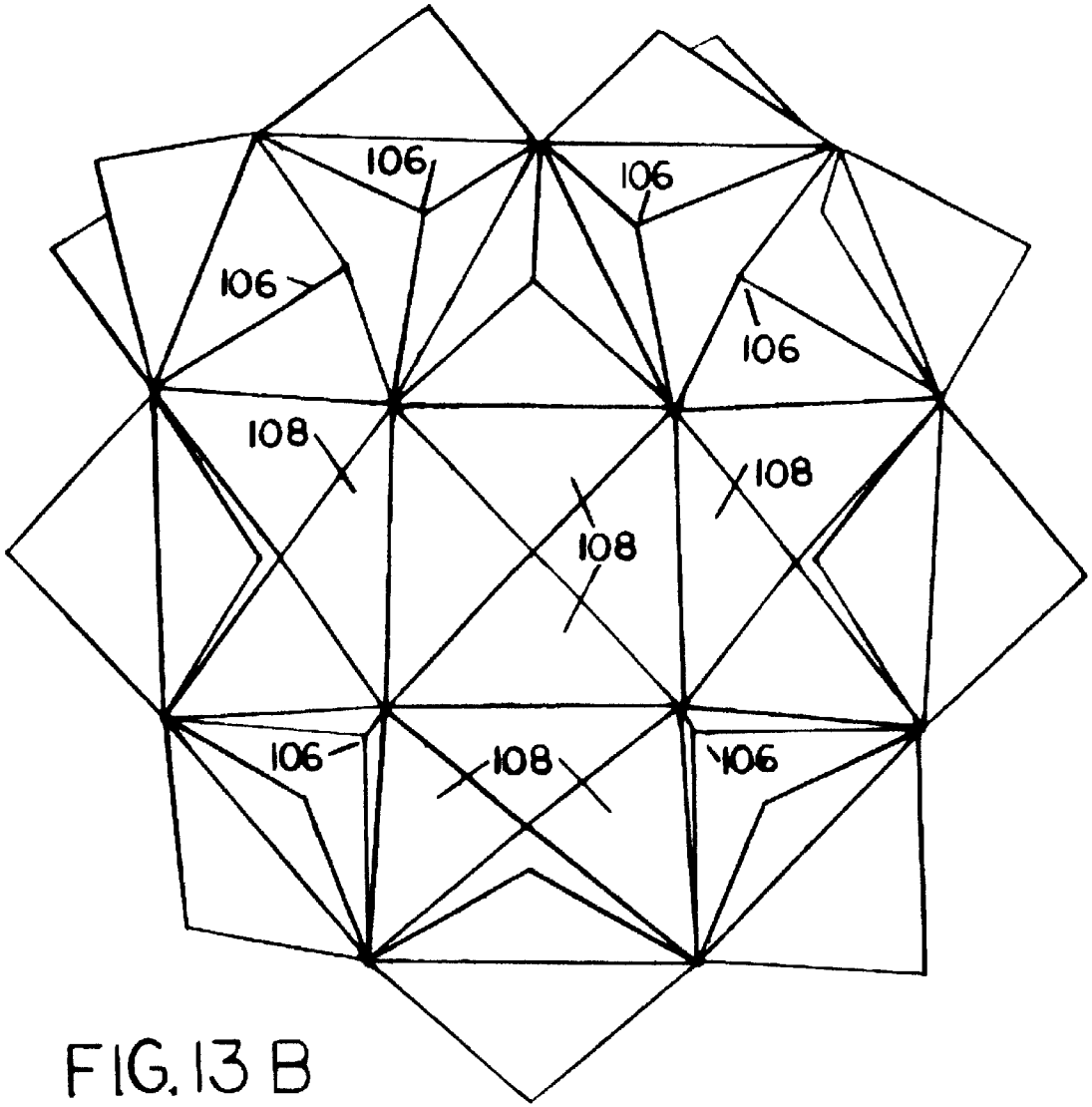

FIG. 13B is a perspective interior view of the structure of FIG. 13A. Shown are tetrahedral structures 106 and substantially flat square areas 108.

Figure 13C:
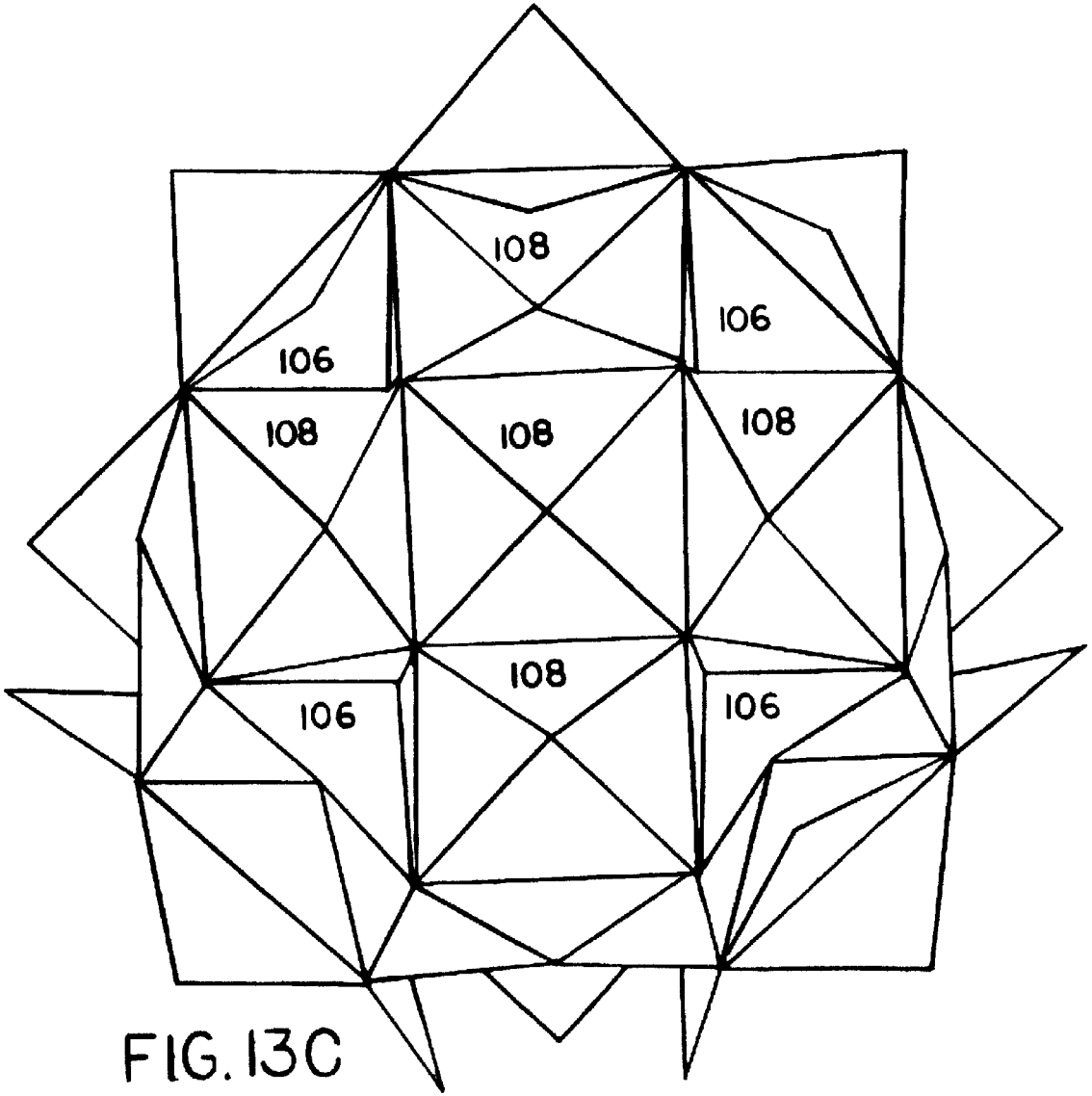

FIG. 13C is a structure similar to the structure of 13B but showing a different array pattern of the forms comprising the structure. FIG. 13C is a more symmetrical structure than 13B having more forms 108 and fewer tetrahedrons 106.

Figure 14A:
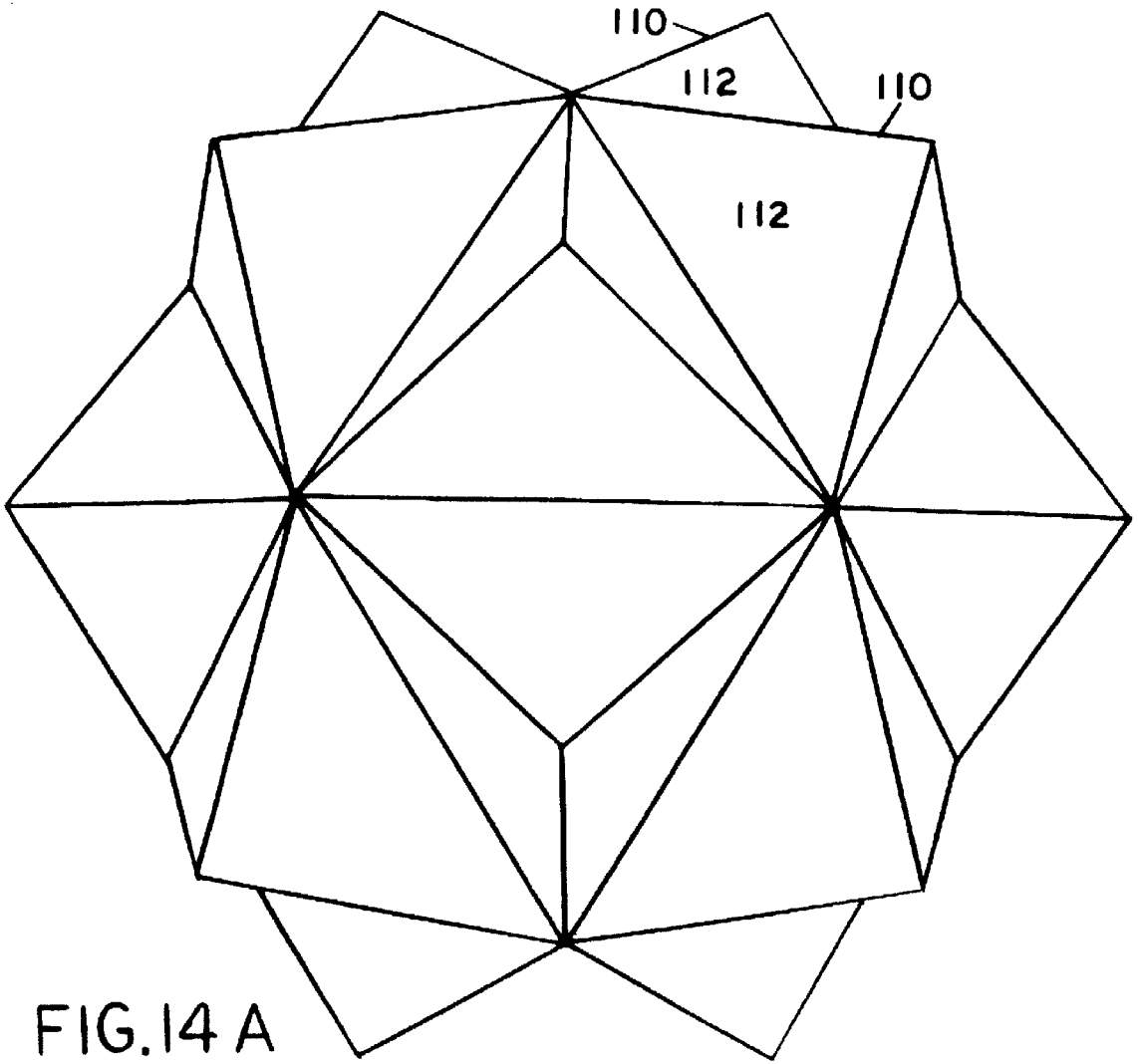
FIGS. 14A-14B show views of a structure made according to the embodiments of the present invention, which is a triakis icosohedron at its exterior and a great dodecahedron at its interior.

FIG. 14A is perspective view of the exterior of a special form of a triakis icosohedron formed according to the instant application of 4-stellate rigid polygonal modules made of non-equilateral triangular polygons. The non-base edges 110 of the tetrahedral protrusions 112 forming the exterior of the structure are coplanar, so that the structure may seat itself on a stellate form of 5 linear foundation lines formed of edges 110. This is the structure of the applicant's prior U.S. Pat. No. 4,682,450 for Combinate Polyhedra, issued Jul. 28, 1987.

Figure 14B:
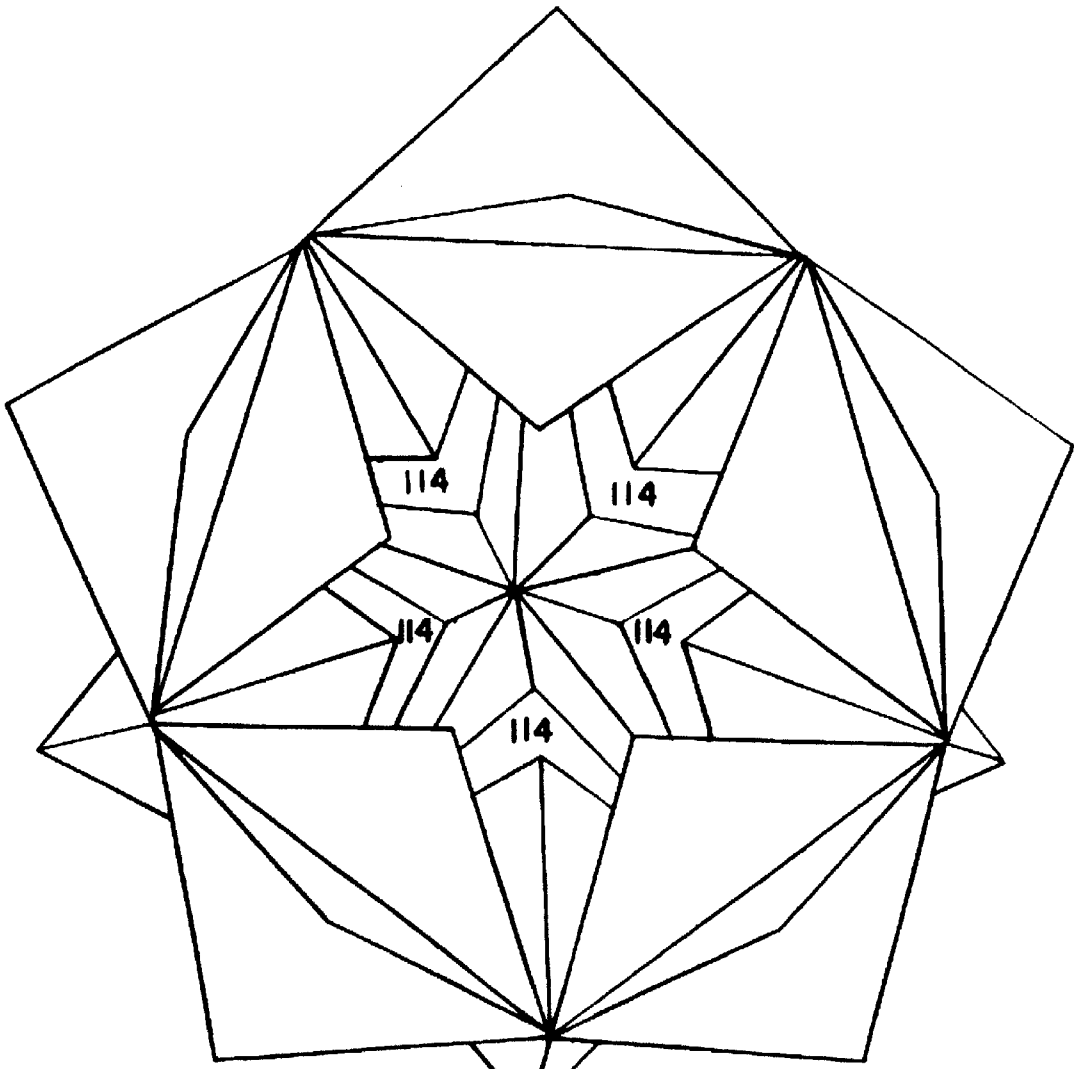

FIG. 14B is a perspective view of the interior of FIG. 14A showing the geometric form of a great dodecahedron. The areas 114 show the adjacency but not joinder of tetrahedral forms comprising a portion of the interior of the structure. The vertices of the several groupings of these tetrahedrons at the interior of the structure are coplanar due to the coplanar orientation of the edges 110 at the exterior of the structure in FIG. 14A, and the essential symmetry of the structure.

Figure 15A:
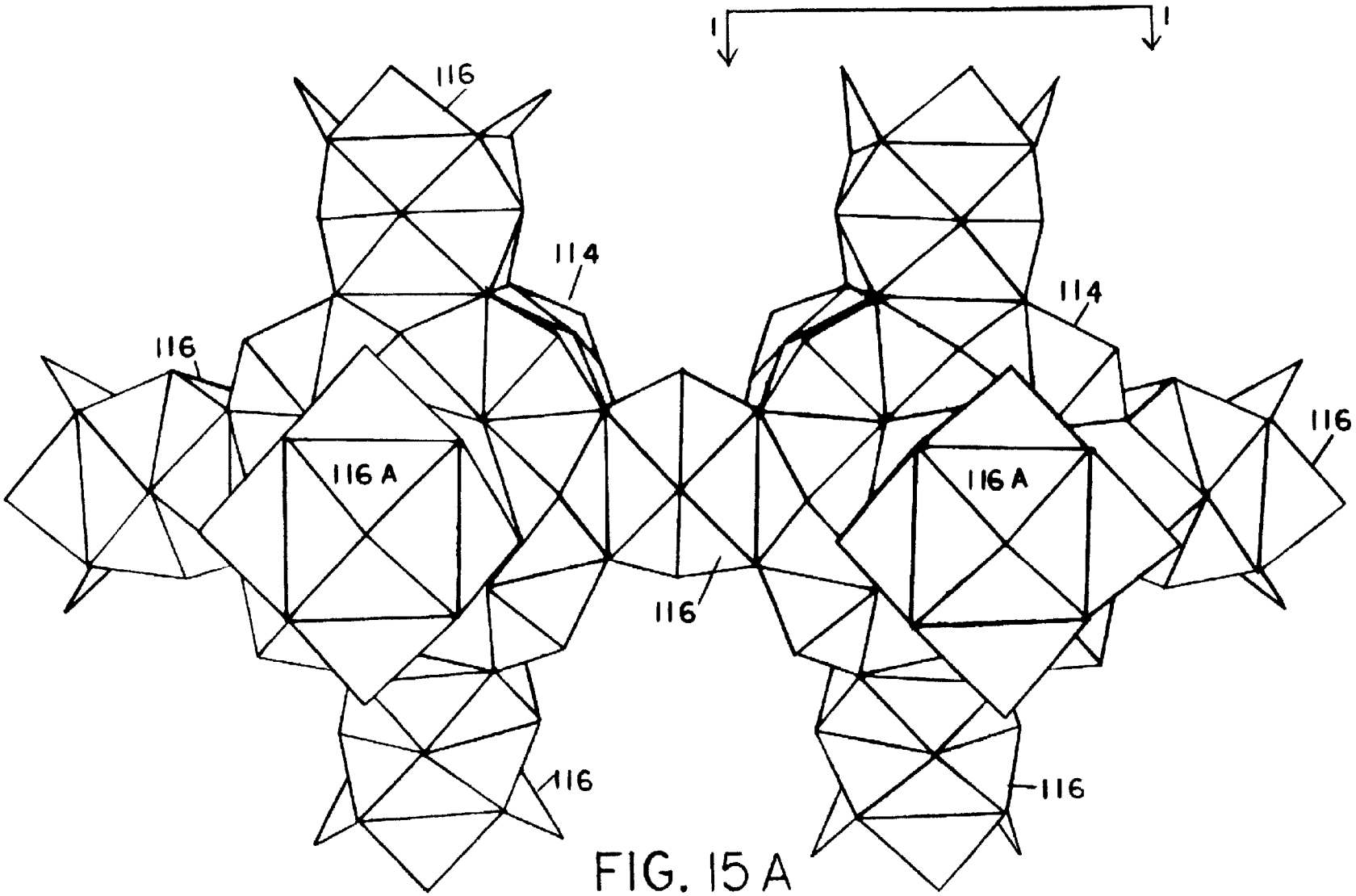
FIGS. 15A–15D show views of a three dimensional rectilinear grid of joined substantially spherical faceted frameworks, joined by sections of faceted substantially cylindrical frameworks.
Figure 15B:
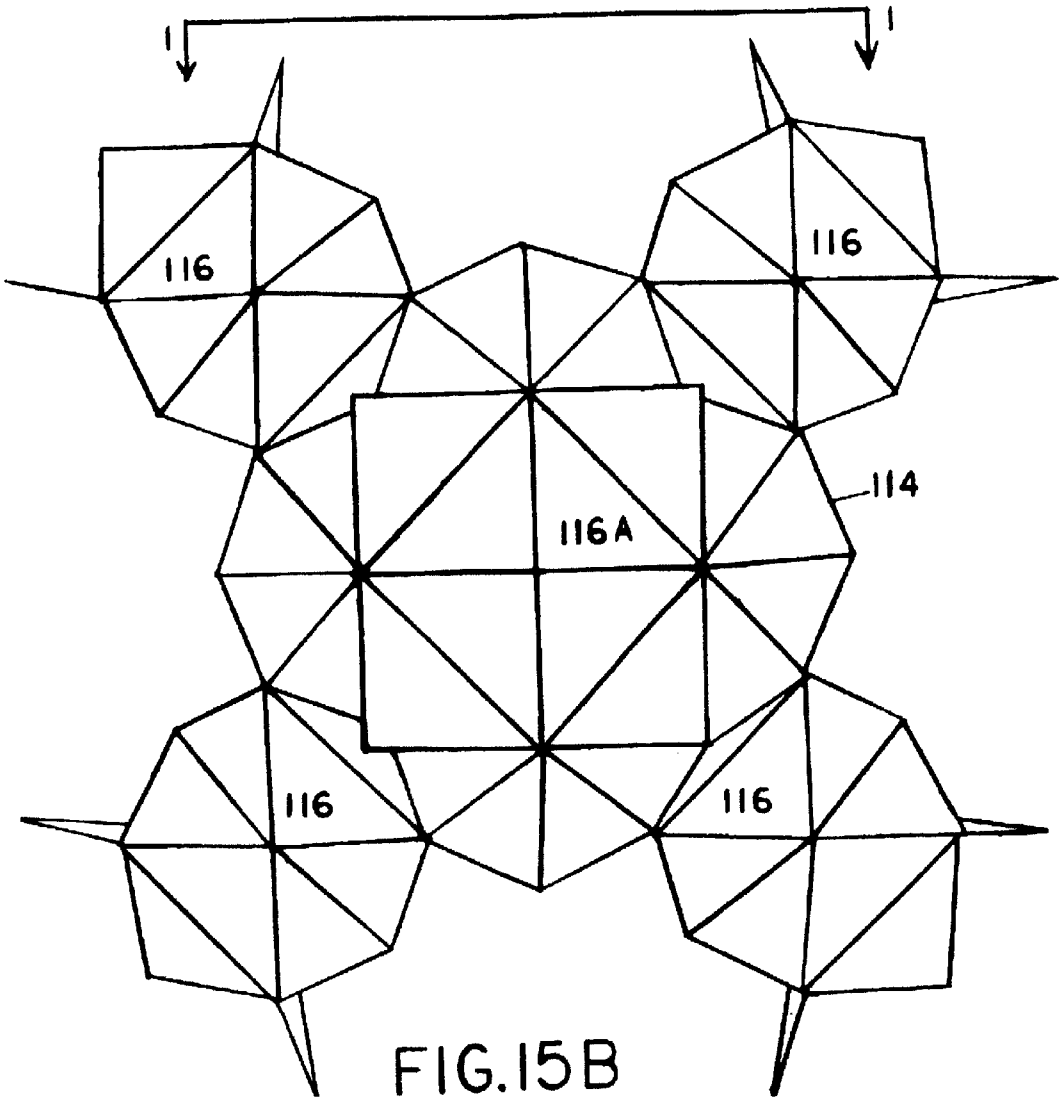

FIG. 15A is an exterior perspective of a structure according to the instant application formed entirely of 4-stellate rigid polygonal modules made of non-equilateral triangular polygons. The Figure shows two identical faceted substantially spherical structures 114 joined together by the junction of each to a faceted substantially cylindrical structure 116. Additional structures 116 are located on rectilinear axes allowing the entire structure to form a rectilinear grid of faceted spherical structures. Structures 116 have internal bulkheads formed from the initial polygons of embodiments of the present invention shown at the exposed interior of the cylinders 116A. FIG. 15A shows a structure which is symmetrical and therefore may be extended along its axes so that a continuous grid of structures 114 may be joined by structures 116. FIG. 15B is top plan perspective view taken along line 1—1 in FIG. 15A but showing only one of the structures 114. 116A shows a plan view of one of the bulkheads at the interior of one of the faceted cylinders 116.

Figure 15C:
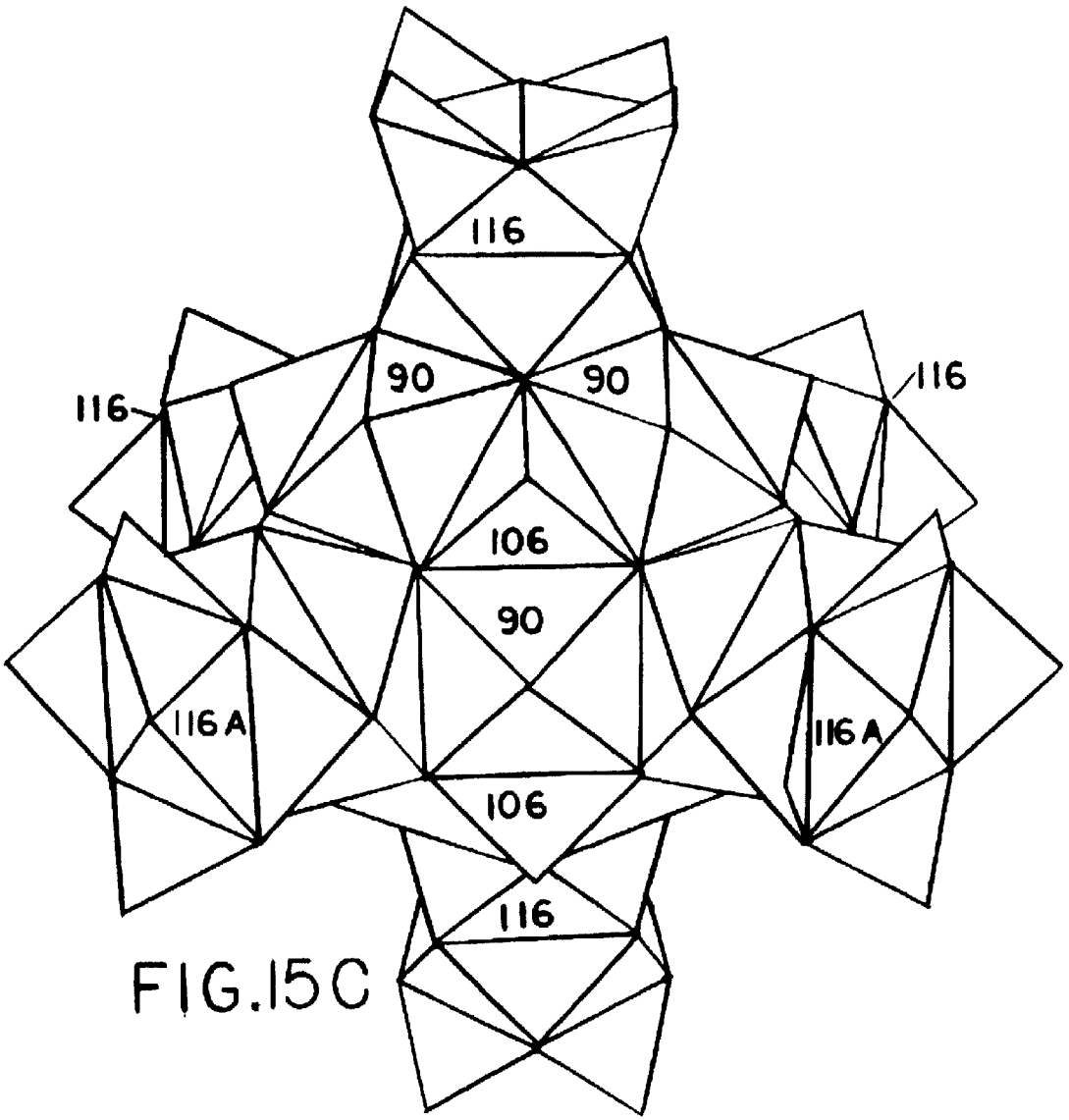

FIG. 15C is a perspective side view of the exterior of the structure of FIG. 15B taken along line 1—1. Shown are tetrahedral structures 106, shallow octohedral structures 90, faceted cylinders 116, and bulkheads 116A.

Figure 15D:
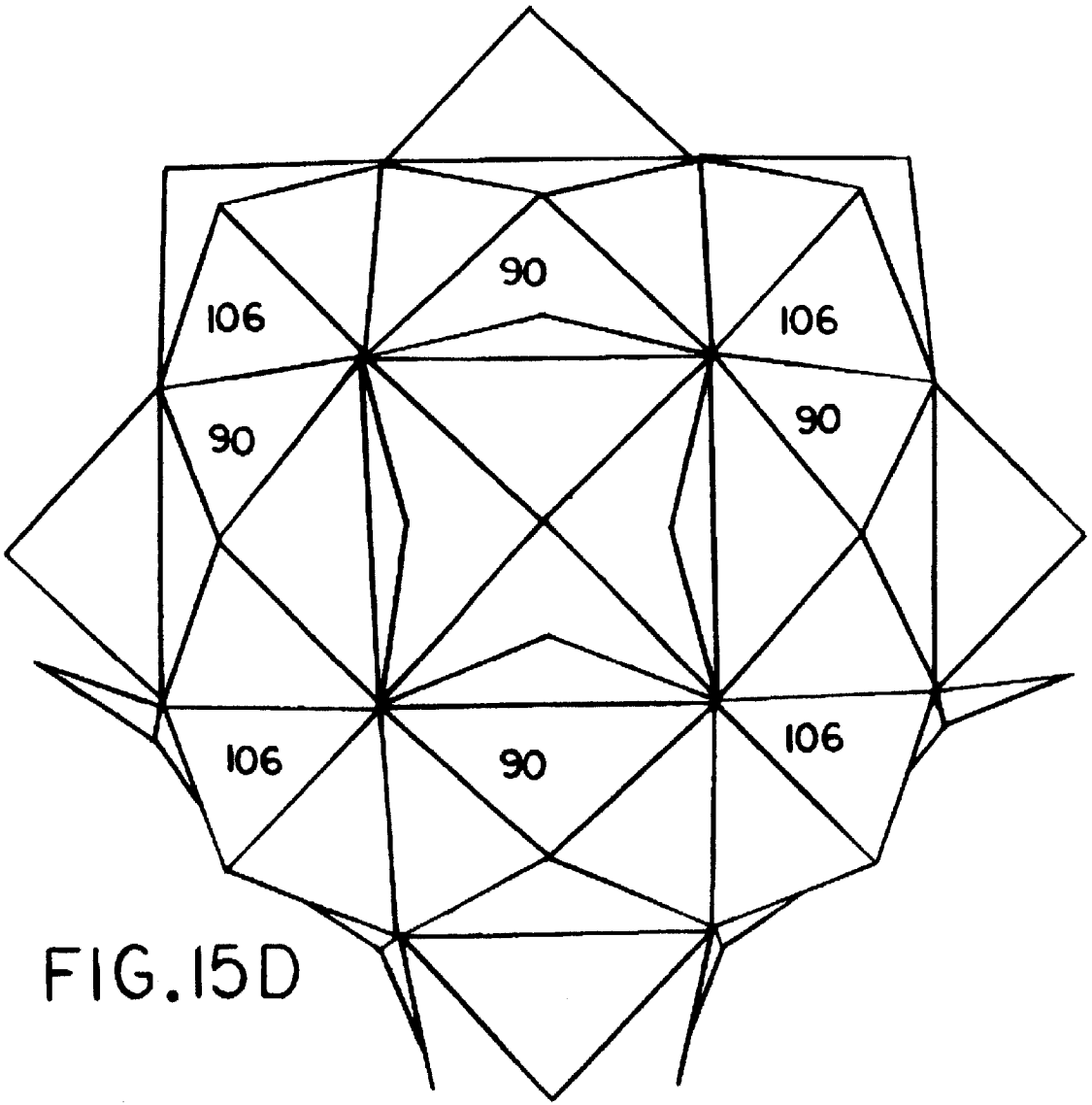

FIG. 15D is a perspective view of the structure of FIG. 15C with the faceted cylinders removed.

Figure 16A:
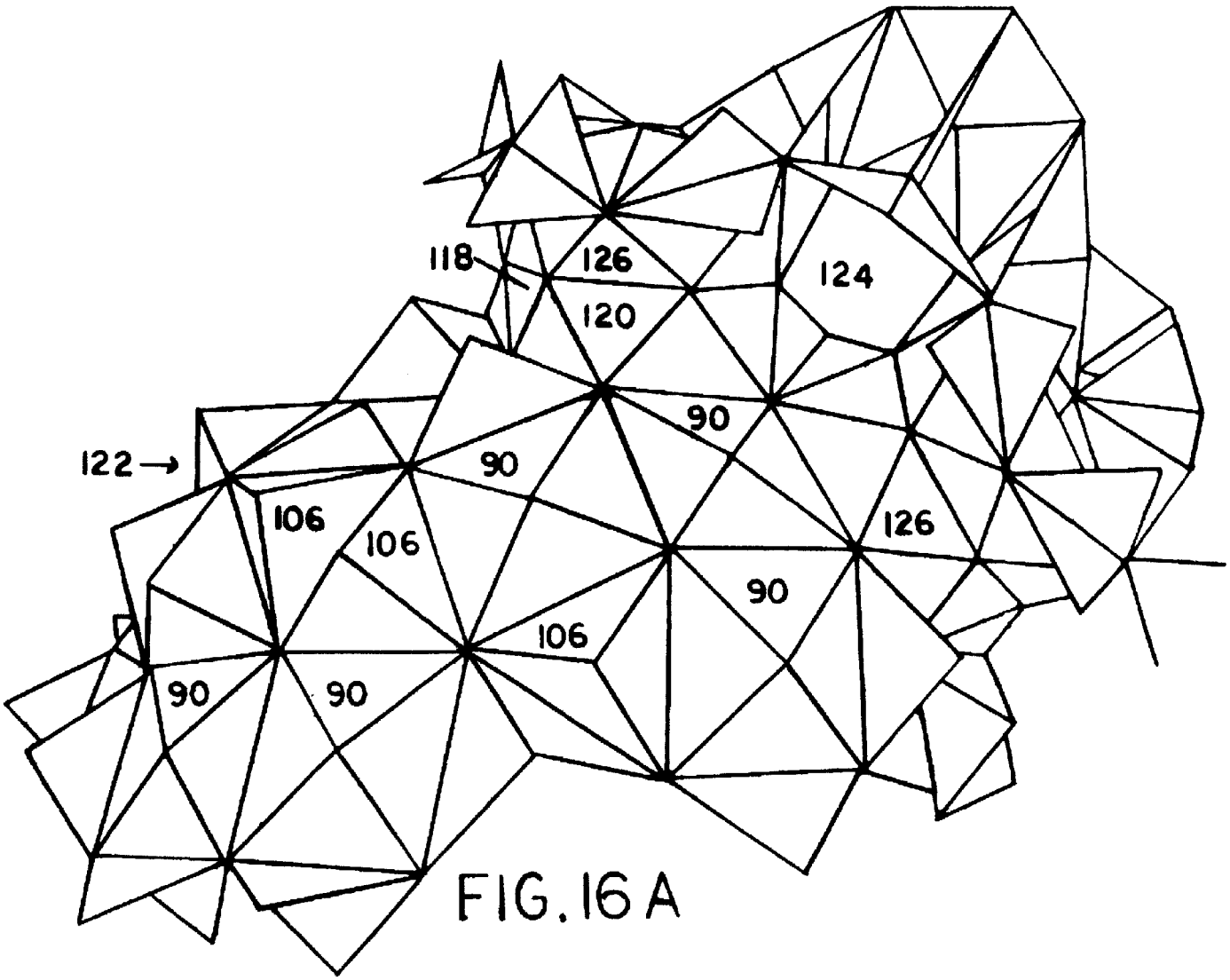
FIGS. 16A–16C show views of an very complex polyhedral structural framework, made from the embodiments of the present invention, having the form of four complex faceted substantially spherical structures joined together through a substantially tetrahedral manifold formed of the joinder of four faceted substantially cylindrical frameworks.

FIG. 16A is a perspective partial view of the exterior of an extremely complex structure according to an embodiment of the present invention. It is formed from both 3-stellate rigid polygonal basic modules 118 utilizing equilateral triangular polygons and 4-stellate rigid polygonal basic modules 120 utilizing non-equilateral triangular polygons. This structure has the general form of the joinder of four faceted substantially spherical structures intersecting through a complex manifold shape formed of the joinder of the adjacent exteriors of several faceted cylindrical structures 126. The exterior of one of the spherical structures 122 is shown adjacent to a portion of the manifold 124.

Figure 16B:
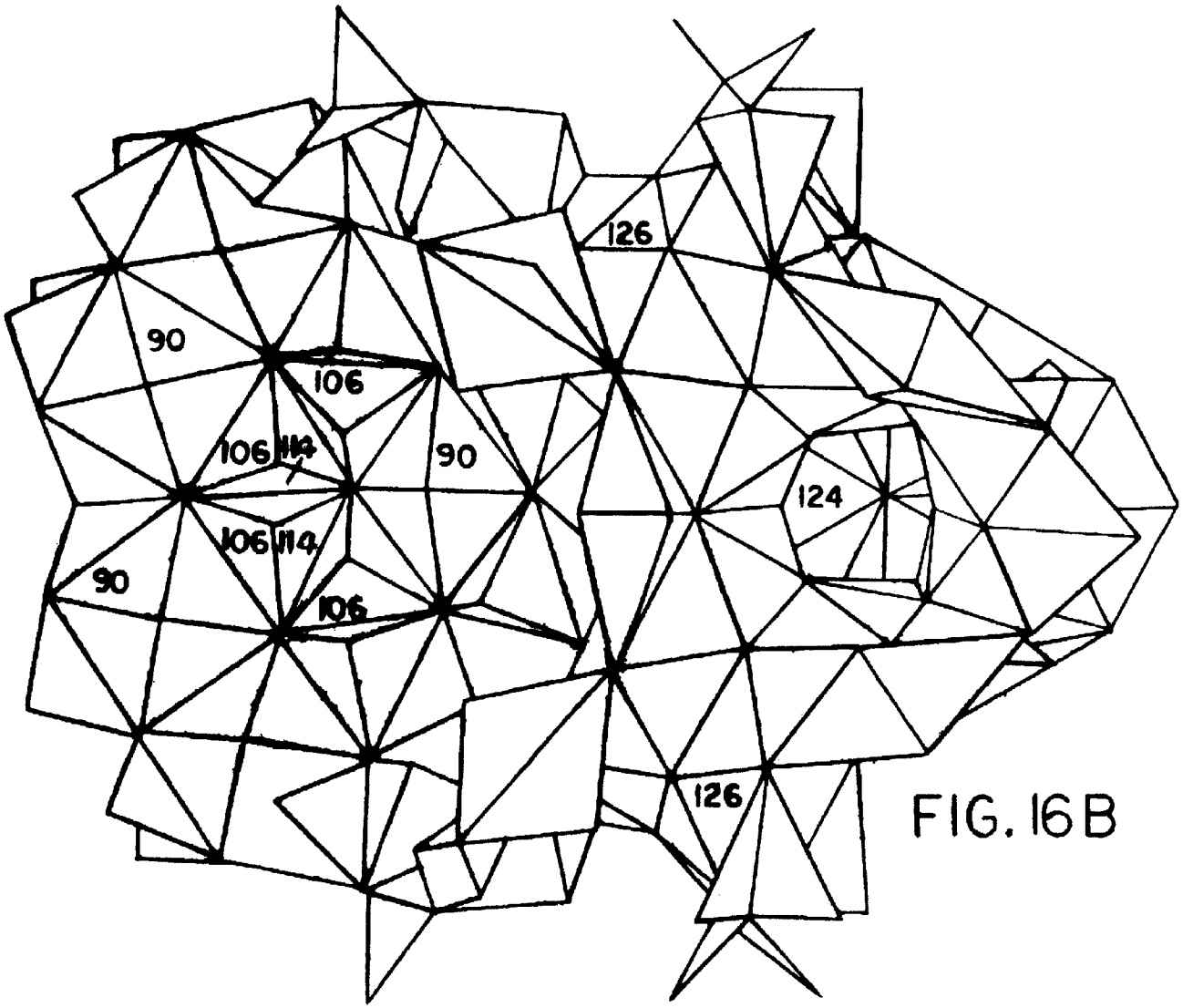

FIG. 16B is an interior perspective view of the structure of 16A. The intersection of the 4 faceted substantially spherical structures is partially shown in the manifold void area 124. The faceted cylinders 126 are shown, and the complex polyhedral interior structure is shown to be partially formed of shallow octahedrons 90, and tetrahedrons 106. Areas 114 are spaces formed between the tetrahedrons and other forms of the structure and is similar to the area 114 in FIG. 14B, again showing the continuity of forms between the several structures of the present invention.

Figure 16C:
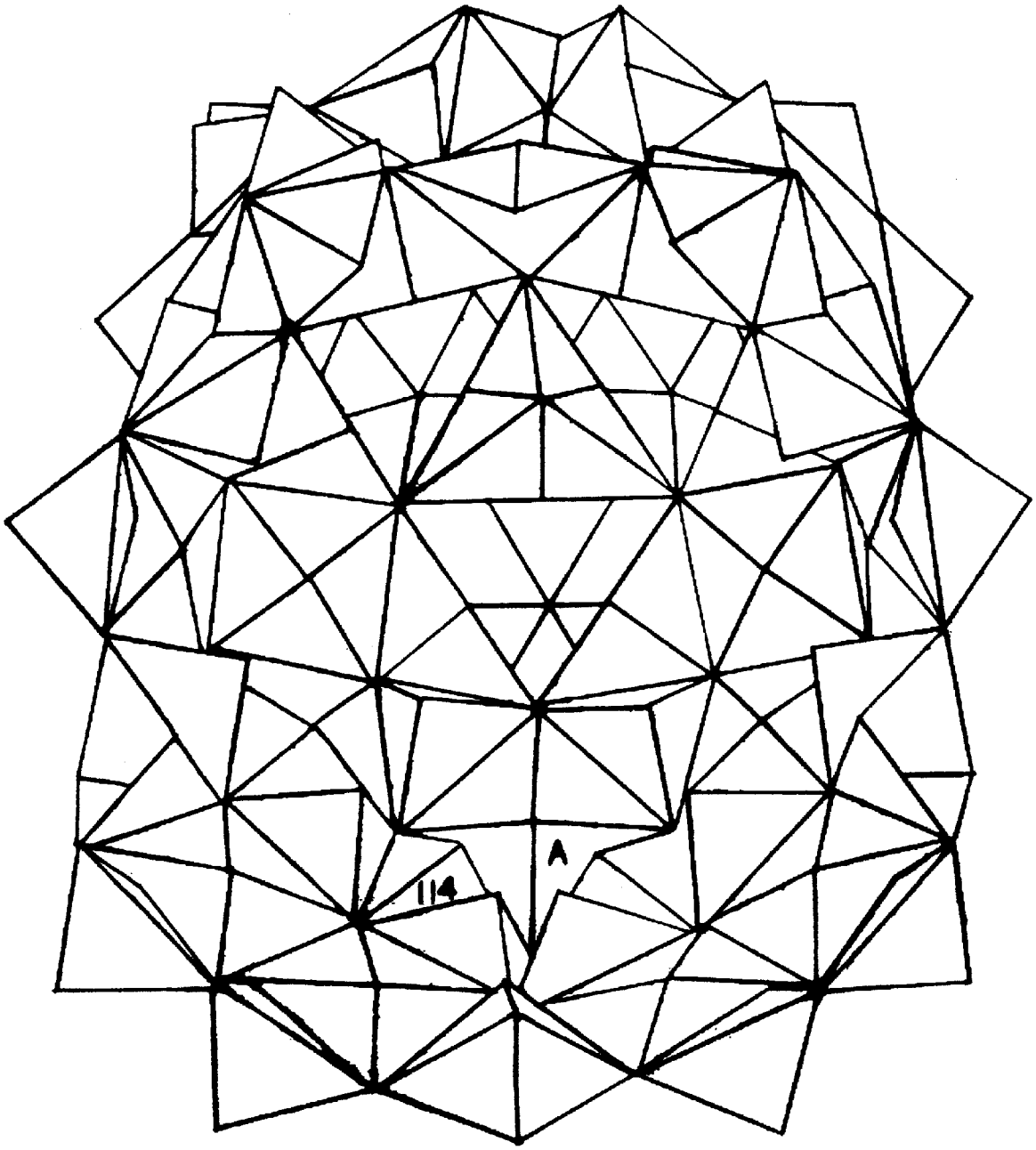

FIG. 16C is an additional perspective view of the interior of the structure of FIG. 16A. Shown is area 114 being the space between several of the component parts of the structure, which is similar to area 114 in FIG. 14B.

Figure 17:
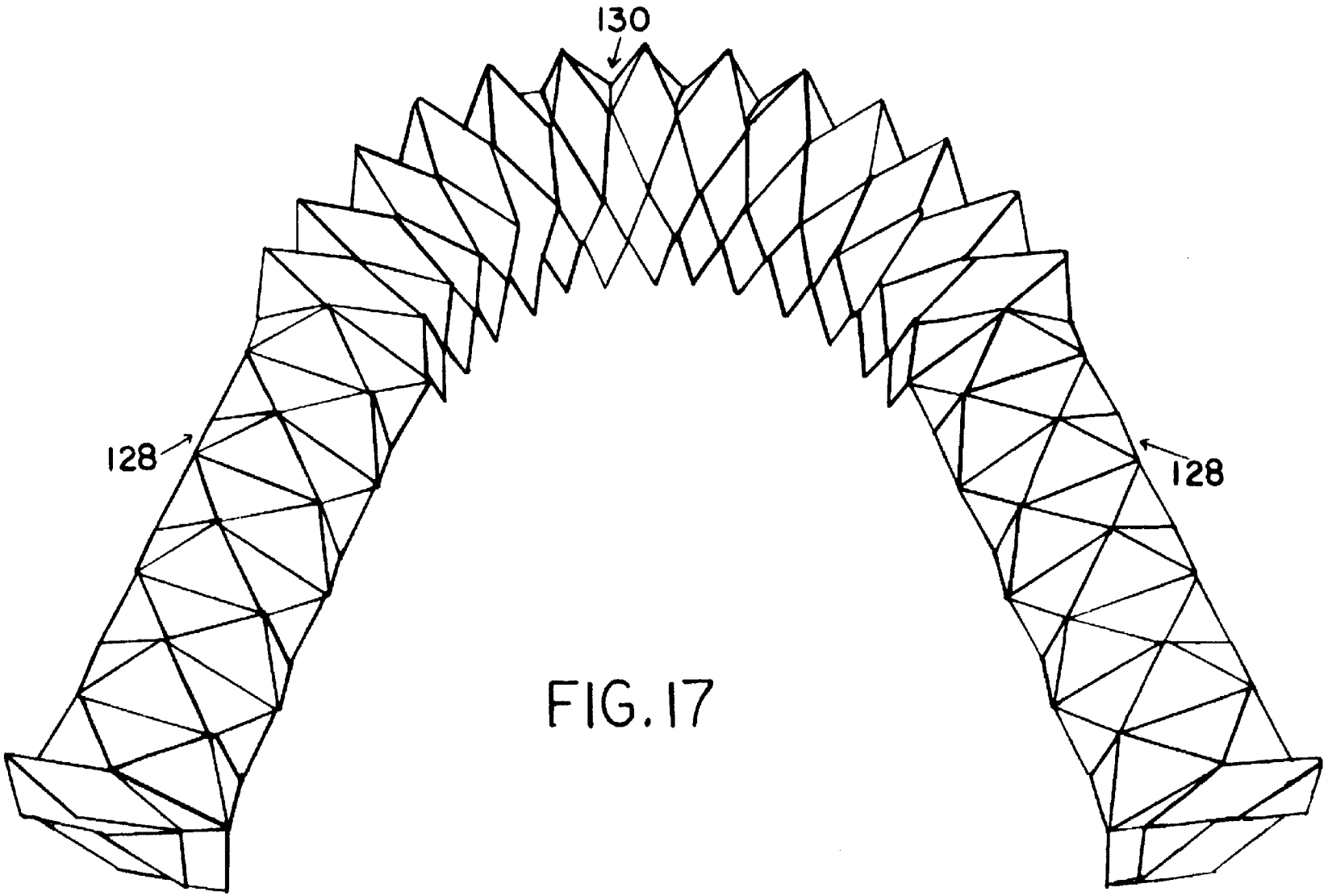
FIG. 17 shows a view of the joinder of two sections of rigid faceted substantially cylindrical polyhedral frameworks, joined across a flexible variable framework made from the identical structural subassemblies as the two rigid frameworks.

FIG. 17 is a perspective view of the exterior of a structure having a rigid faceted cylindrical structure 128, at each of its ends joined to a flexible egg-crate like structure 130, at its center. The faceted cylinders 128 have at their interior bulkhead structures similar to those above-described in other faceted cylinders of the present invention, being formed of several of the initial polygons of embodiments of the present invention joined, using 4-stellate rigid non-equilateral polygons.

Figure 18:
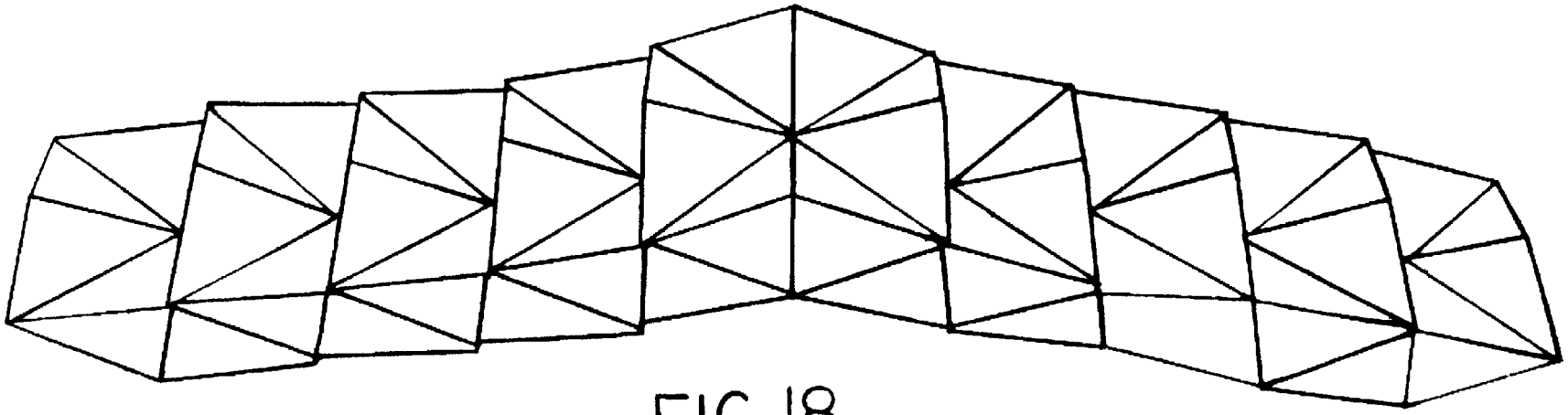
FIG. 18 is a view of an assembly of portions of shallow octohedral frameworks according to embodiments of the present invention, joined into a trusslike assembly.

FIG. 18 is a perspective view of a truss-like structure according to an embodiment of the present invention. It is formed entirely of several 4-stellate rigid non-equilateral polygonal modules according to embodiments of the instant application joined.

The ratio of the dimensions of the base edge of the polygons at the rigid stellate joinder to their side edge dimension produces initial polygons and therefore subsequent polyhedral structures of different form. In several preferred embodiments the dimensions are such that the angle subtended by the two sides of the polygon forming the vertex opposite the stellate joinder axis may be 60 degrees, 90 degrees or approximately 108 degrees, or other useful angles, each forming different rigid polyhedron structures. However other polygons may be used, and the preferred embodiments shown in the drawings and descriptions in the instant application are only used to show some particular specific uses of the generic device taught in the present invention.

In a preferred embodiment of the present invention, a three-way rigid stellate connecting of three rigid polygonal structural panels corresponds to a preferred angle of 60 degrees for the angle of vertex of the polygon opposite the base edge of the polygons of the rigid stellate assembly of the rigid stellate axis, a four-way rigid stellate connecting of four polygonal panels corresponds to a preferred angle of 90 degrees for the angle of the vertex of the polygon opposite the base edge of the polygons of the rigid stellate assembly, and a five-way rigid stellate connecting of five polygonal wall panels corresponds to a preferred angle of substantially 108 degrees for the angle of the vertex opposite the base edges of the polygons at the rigid stellate assembly device. These preferred angles may be used to form useful complex polyhedrons, but other angles may also be used for the formation of other polyhedrons.

FIGS. 4A–4C show some of these useful polygonal wall panels corresponding to the above dimensions. FIG. 4A shows the opposite angle within the wall panels, 38 to be 60 degrees corresponding to a three-way rigid stellate assembly, three-polygonal paneled assembly. FIG. 4B shows the angle opposite the rigid stellate device as 90 degrees corresponding to a four-way rigid stellate connection, four paneled rigid stellate assembly, and FIG. 4C shows an opposite angle of 108 degrees, corresponding to a five-way rigid stellate assembly, five paneled rigid stellate module. A truncated panel line 40, shows that a panel may be modified to allow for the formation of openings in the polyhedral structures making tunnel regions connecting different areas within the polyhedral structures. In FIGS. 4A-B a portion of a rigid stellate connector 6 along a base edge or at the end along a base edge of a non-rectilinear polygon is shown. In FIG. 4B an additional rigid stellate connector 6B at an interior location along a side edge of a polygon and additional connector at the end along a side edge of a polygon is shown.

For a given number of wall panels variably attached about a given rigid stellate axis, some preferred embodiments relating the side dimensions of the polygonal wall panels and therefore the angle subtended by the side dimensions of the polyhedral wall panels are as follows;

Sixty degrees for the angle opposite the rigid stellate axis is useful when three polygonal wall panels meet at a rigid stellate device, Ninety degrees for the angle opposite the rigid stellate axis is useful when four polygonal wall panels meet at a rigid stellate device, One hundred eight degrees for the angle opposite the rigid stellate axis is useful when five polygonal wall panels meet at a rigid stellate device. The above angles are only some preferred embodiments, and other useful angles and corresponding lengths of edges of the polygons are possible to produce useful polyhedral structures.

Typical embodiments of the basic module of the present invention are shown in FIGS. 1A–1D, in plan view. The stellate nature of the multi-leaved rigid stellate panels is shown clearly. 1A shows a two-way rigid stellate assembly of non-rectilinear polygons, 1B shows a three-way rigid stellate assembly of non-rectinlinear polygons, 1C shows a four-way rigid stellate, assembly of non-rectilinear polygons and 1D shows a five-way rigid stellate assembly of non-rectilinear polygons. Other possibilities, for example a seven-way rigid stellate assembly are also possible. The angle between the several panels 7, may vary. This indicates the different orientations between the joined possible locations of the several rigid stellate polygonal panels.

A typical embodiment of two basic modules of the present invention joined is shown in perspective view in FIG. 2. A rigid stellate connection 6 which may be a continuous connection or a group of connections at several points along the stellate axis, forms a central axis about which are attached polygonal wall panels 4, which are attached at the base edges 5 of the polygon, and which polygonal wall panels are further made up of side edges.

In FIG. 3, the teaching of the basic rigid stellate module 1B–1D, of the device of the present invention may be a two-way or more than two-way rigid stellate device with thereby two or more polygonal wall panels attached about the basic rigid stellate axis shown in FIG. 3 with two polygons shown attached at a three-way rigid stellate connection, as above mentioned. The additional connector 6A-6B, which may be a rigid stellate device or a simple connector device, is typically used to attach together several of the basic modules of the present invention at the side edges 5A, of the polygons, at various angles of relation to each other. In this way, by the additional aggregation of multiple modules according to the present invention the complex polyhedral forms of the present invention are formed.

The additional connection 6A-6B, may have only two polygons meeting at its axis being a connection forming either a two-way rigid stellate device or a two-way connection , or may have three or more polygons meeting at their edges at the additional rigid stellate assembly being a three-leaved device forming either a three-way rigid stellate connection or three-way rigid stellate device. In some preferred embodiments, only two polygons are joined at their non-base edges at the additional connection 6A-6B. However when more than two polygonal non-base edges are joined, in order to further stiffen the structure, the additional connection 6A-6B is more than a two-way connector or rigid stellate device. The placement alone of the stellate polygonal basic modules forms the specific geometry which causes the non-rigid basic modules to together form rigid polyhedral structures.

FIGS. 4A–4C show typical polygonal wall panels according to embodiments of the present invention.

FIGS. 6–18 are specific embodiments of complex polyhedral structures formed from combinations of the basic modules of the generic teaching of FIGS. 1–4.

From the description above, a number of advantages of the stellate-joined polygonal modules become evident:

(a) A multiplicity of different structures may be formed from the same extremely simple device, whose constituent parts are similar and interchangeable.

(b) Only one or two different lengths of polygonal sides and one or two different lengths of rigid stellate base edges may be required to achieve the great diversity and complexity of polyhedrons formed by embodiments of the present invention.

(c) All of the structures of embodiments of the present invention may be clad in simple polygonal panels, at its interior and at the exterior.

(d) A family of structures may be achieved using standard non-rectilinear polygonal structural construction panels, and joining at least three of them together in a rigid stellate form at their base edges, by varying the angles subtended between the several panels by the use of different rigid connectors, and by connecting many of the rigid stellate assemblies together, thereby achieving the family of structures.

(e) The embodiments of the present invention will form a great variety of useful new complex polyhedrons not previously known in the prior art.

(f) The embodiments of the present invention will form complex polyhedrons which have discrete stiffening and rigidifying structures located at both the interior and at the exterior of the structures.

OPERATION FIGS. 1–18

The manner of using the embodiments of the present invention involves building up complex polyhedrons from the multiple use of simple linear strut members and simple polygonal panels joined about a rigid stellate device. The basic module embodiment of the present invention is shown in several embodiments in FIGS. 1A–1D. They are shown to be rigid stellate-like modules with varying numbers of polygonal panels 4, attached. The simple polygonal panels 4, have a base edge 5, which is first connected to a rigid stellate device 6, and have remaining side edges 5A. Several polygonal wall panels 4, may be connected at their base edges 5 in a stellate manner about the axis 6E of the rigid stellate connection device 6, thus forming the basic stellate module according to embodiments of the present invention. This is shown along with some additional panels attached in FIG. 2.

After forming a first basic module according to an embodiment of the present invention as above described, additional modules are connected together along their side edges 5A, using either additional rigid stellate devices 6A,6B, or other rigid stellate linear connectors continuous along the length of the base edge 6D.

The side edges 5A of the polygons may be attached in two different array patterns, each yielding different polyhedral structures. The side edges may be attached using an additional rigid stellate connector 6D which may be any of the types 6A at an end of side edge, 6B at an intermediate point along the edge, or 6C a continuous connector with the alignment such that the vertex corner of the polygons opposite of the rigid stellate axis are aligned abutted adjacent to each other. In this case two of connecting devices 6 meet at the end of the axis 6E. Alternately, the side edges of the polygons may be attached using additional rigid stellate connector 6D, which may be of the types 6A, 6B, or 6C with the alignment such that one vertex end of the polygon opposite the rigid stellate axis is aligned abutted adjacent to the vertex corner of a base edge and a side edge of the polygon at the rigid stellate axis 6E. In this case the connecting device 6 at the base edge of a polygon, is joined in an orientation abutting coincidently to a connector 6A at a side edge 5A of a polygon.

By subsequent additional aggregations of additional basic rigid stellate modules to a first joined two basic modules, and by the additional connection of additional polygonal panels by the use of the connecting devices of additional rigid stellate modules rigidly joined at their base and side edges, complex polyhedral structures may be progressively built up.

The building up of complex polyhedral structures with discrete interiors and exteriors by the connection of several rigid-stellate-polygonal modules and additional polygonal panels proceeds to form in some cases groupings of deltahedrons joined at their bases, in other cases shallow octohedrons which may be joined at their bases. These groupings may be further connected to form various complex polyhedrons.

Trussed and triangulated structures having substantial depths and various geometric shapes may also be formed by the continued connection of multiple basic modules and additional polygonal panels utilizing the stellate-rigid stellate polygonal embodiment of the present invention.

Complex spaceframe structures having various geometric shapes may be formed by the continued connection of multiple basic stellate modules and additional polygonal panels utilizing the basic rigid-stellate polygonal embodiment of the present invention.

For some configurations, basic modules may be connected to each other at their side edges 5A by an additional rigid stellate connector 6D, of the types 6A, 6B or 6C, so that the angles subtended by the side edges of each of the polygons forming the vertex opposite the rigid stellate axis are each abutted adjacent to each other. In other configurations the basic modules may be so joined together that the vertex angle opposite the rigid stellate axis of one polygon may be oriented so as to be abutted directly adjacent to a location at the ends of the base edge of the rigid stellate axis of another polygon, in order to form a different array pattern and achieve different complex geometries.

The making of the multi-leaved rigid-stellate polygons as above-described as well as the combining of different numbered rigid-stellate, for example three-way rigid stellate, or four-way rigid stellate, and the different angles subtended at the vertex angle of the polygonal panels opposite the rigid stellate axis, and the different orientations of joined adjacent modules, either opposite angle to opposite angle or opposite angle to vertex of base and side edge at the rigid-stellate axis 6E end, in their various combinations is responsible for the great variety and complexity of polyhedrons which may be achieved and is one part of the new teaching of embodiments of the present invention.

In some cases a species of the instant application has interior and exterior structures being the mirrored discrete opposites of each other but being the identical geometries though reversed; for example in FIGS. 6A,6B,7,12C,14A, 14B: and in some other cases a species has discretely different geometries on the interior and exterior of the structure; for example FIGS. 8A,9A,10B,11A,11C,11D, 15A,16A,17.

In some cases structures at the interior are reversed identical but not located exactly as mirrored opposites, for example FIGS. 12A, 12B.

The varying rigid-stellate polygonal feature of the instant application allows for many different geometries and different polyhedrons to be formed and subsequently modified or dismantled and reassembled differently into different forms from the same kit of parts. In each embodiment of the present invention, at least one of the non-rectilinear polygons forms a portion of the exterior of the polyhedron, and at least one of the non-rectilinear polygons extends into and thereby forms a part of the interior of the polyhedral structure according to the present invention. However, since the complex structures newly discovered through experimenting with this rigid-stellate variable geometric device are also a new teaching of the present invention being complex polyhedrons completely unknown in the prior art, neither their specific interiors or their specific exteriors ever before taught in the prior art, such structures in and of themselves would also constitute a device according to the present invention, being a member of the new family of polyhedrons according to the present invention, having the discrete interior and exterior as newly-taught and above-described, when formed as multiple rigid stellate modules joined, though formed through alternate methods or devices, for example casting.

The rigid stellate device therefore is both a device for forming the newly discovered polyhedrons and is also a description of the new geometric family of the polyhedrons so formed, called "complex polyhedrons with discrete interiors and exteriors from rigid-stellate polygons". Therefore building the structures formed according to embodiments of the present invention, but not using the specific rigid-stellate device to connect the polygonal panels, but using instead different rigid-stellate connectors known in the prior art would still be forming the newly discovered complex polyhedrons of embodiments of the present invention, and would also constitute a device according to an embodiment of the present invention, since the polyhedrons themselves are a new teaching of the instant application.

In addition, omitting some or all of the new teaching of the discrete interior framework, would, for the geometries newly disclosed also constitute a device according to an embodiment of the present invention, since the new teaching includes in some embodiments the newly disclosed geometries themselves of the rigid complex polyhedrons formed through the basic rigid-stellate module according to an embodiment of the present invention, as described in the appended claims. This is because the newly disclosed geometries themselves, therefore, which are rigid in and of themselves with their exterior forms only, and where the interior frameworks only serve to additionally rigidify the structures, would themselves comprise and constitute a device according to an embodiment of the present invention.

Embodiments of the present invention teach a practical method to form complex structures from very simple parts; it is therefore a pragmatic embodiment in physical objects of one of the ways in which complexity arises out of simplicity. The complete catalogue of useful structures possible to be constructed from embodiments of the present invention has not yet been exhausted as the simple variations possible of the component parts are numerous and not yet fully discovered. The device of the present invention is a tool to discover the full range of the new geometric species according to the instant application. The applicant continues to develop new geometric models from embodiments of the present invention, using only the particular features included in the appended claims.

In addition, using a small beginning number of basic modules of the instant application, a small structure may be initially constructed. Then with the addition of greater numbers of basic modules according to embodiments of the instant application, a more complex and larger structure may be formed by reconfiguring the initial construction into a larger enclosure. A new type of building technology is taught wherein the several parts are substantially identical and therefore interchangeable and reuseable.

At the inventions most basic level, by starting with a single non-rectilinear polygon having an at least three-stellate connector at its base edge and a two-stellate connector at it side edges, a rigid-stellate joinder of multiple non-rectlinear polygons as a basic module may be formed. Then by progressively joining additional modules together, the continual progressive stiffening and building up of an increasingly complex polyhedron represents a new type of construction technology.

In addition, the non-rectilinear polygons may be simple triangular or hexagonal or other similar molecules, and the progressive building up first, from non-rectilinear molecules into stellate molecules, and then the joinder of multiple stellate molecules into larger more complex, more structurally strong and stable substantially rigid constructions of polyhedral molecules.

SUMMARY, RAMIFICATIONS, AND SCOPE

Thus the reader will see that the various multiple rigid-stellate polygonal modules of the invention formed of rigid-stellate polygonal panels are joined with others of like kind making a new useful family of rigid complex polyhedral models with discrete interior and exterior structures. At least one of the polygons of each basic module forms part of the exterior of the structure, and at least one of the polygons of each of the basic modules extends to and forms some of the interior of the structure. The models can be used in frameworks for architectural or engineering or other structures, or in compositions of matter.

A new family of complex concave polyhedral models is disclosed in embodiments of the present invention. A new family of rigid frameworks are disclosed which are made from a previously unknown family of polyhedral models. These new polyhedrons are made from the joining of a multiplicity of modules made from rigid stellate joinders of non-rectilinear polygonal structures in a variety of different rigid stellate orientations and arrays.

A minimum inventory, maximum diversity system is taught, having for the simple device invested, a great diversity of complex geometric frameworks possible to be formed by the device. The new structures of the teaching of this application can all be sheathed or covered by simple polygonal panels.

Accordingly, the reader will see that the variable rigid-stellate polygonal panel module of this invention can be easily used to form a great diversity of engineering or architectural structures or toys, and these complex structures can be made from structural members commonly known in the prior art, for example, linear strut; non-rectilinear polygonal panels; simple angled plate connectors, and the like. Furthermore the variable rigid-stellate polygonal panel module has the additional advantages in that

- it permits the formation of a great variety of previously unknown diverse complex polyhedrons made from a simple device, the basic module;
- it permits that the structures formed may easily be disassembled and reconfigured making them larger or smaller or varying the complexity or the array pattern as the need arises since all of the complex structures are formed of the same simple identical kit of interchangeable parts;
- it provides for the formation of structures of complex polyhedrons of such density of triangulated structure that sufficient rigidity is achieved that the structures may resist substantially heavy loads, although they are made from simple linear struts or simple planar panels formed into various stellate modules;
- it permits, because of the simplicity of forms of the basic modules, that a manufacturing enterprise may be developed with ease and using only known industrial processes.
- it provides a very simple modular device which may be arrayed and configured into a great variety of forms enclosing small and large volumes of great diversity; an entire small city may be formed using only the basic module of the instant application.

Although the description above contains many specificities, these should not be construed as limiting the scope of the invention but as merely providing illustrations of some of the presently preferred embodiments of this invention. For example the polygonal panels may be curved panels; dimensions of the individual polygons may be altered to change the subsequent resulting complex polyhedrons thus formed; various combinations of different basic rigid-stellate modules may be utilized, such as a combination of each of a three-way a four-way and a five-way rigid-stellate module may be utilized to achieve a finished form of a complex concave polyhedron; the structures of embodiments of the invention may be combined with traditional known structures of the prior art; the structures of the invention may be additionally truncated, dissected, stellate or aggregated or a combination of these to form additional complex structures. For example a triangular polygonal panel as abovedescribed may have its vertices truncated to form a six-sided polygon used in a rigid-stellate module to form additional tunnel regions within the complex structures of embodiments of the present invention.

In addition, the stellate connection of the present invention may be formed as a structure which provides for the coupling to polygonal structures. Therefore utilizing the combination of the teaching of the present invention of an at least three-stellate polyhedral structure wherein the stellate form is coupled together at the base edge of a polyhedron by a connector, in concert with a typical two-stellate structure of the prior art when coupled to the side edges of the polygonal structure, and when multiple such polyhedrons are coupled at the edges of the polyhedrons, this yields the new family of deltahedral polyhedrons with discrete interiors and exteriors of the present invention. Therefore a three-stellate connection structure according to the present invention allows for the formation of the polyhedrons of the present invention.

FIG. 5 shows a perspective view of a typical non-rectilinear polygonal according to the present invention having a three-way stellate connector at its base edge and a two-way stellate connector at one of its side edges.

In addition, the polygonal structures of the present invention may be formed of non-rectilinear assemblies of molecules. The rigid stellate modules may be formed of groupings of several coupled assemblies of such molecules. The polyhedral structures may be compositions of matter formed from the coupling of a plurality of such molecular modules.

The compositions of matter so formed from non-rectilinear molecules, will have a greater complexity of structure due to the density of triangulation of the structures of the present invention. Because of this density of triangulation, the compositions of matter formed by such non-rectilinear molecular assemblies will also be more stable than the family of chemicals known as "Fullerenes" since the present invention teaches a greater density and complexity of structure than the geodesics upon which "Fullerenes" are based.

As abovementioned the device of the instant application is also a tool which may be used to develop additional complex polyhedrons of the generic family of the polyhedrons of the present invention.

Thus the scope of the present invention should be determined by the appended claims and their legal equivalents, rather than by the examples given.

Informal drawings are submitted and will be replaced by formal drawings upon allowance.

Alternate embodiments of the complex polyhedrons formed from rigid-stellate polygonal modules are possible using rigid connectors as in previous work by the inventor, and are hereby incorporated by reference, Ser. No. 08/119, 630, Filed Sep. 13, 1993, as described below;

As abovementioned the device of the instant application is also a tool which may be used to develop additional complex polyhedrons of the generic family of the polyhedrons of the present invention.

Thus the scope of the present invention should be determined by the appended claims and their legal equivalents, rather than by the examples given.

I claim:

1. A structure from a family of polyhedral models and rigid structures having discrete interior and exterior structural elements, the structure comprising:

a plurality of basic rigid-stellate non-rectilinear polygonal modules, each module including:

at least three non-rectilinear polygonal structures, each of the polygonal structures having a base edge and at least two side edges;

at least one rigid stellate connector;

said polygonal structures are each coupled by their base edges to said connector at angles to form one of said plurality of basic rigid-stellate polygonal modules;

wherein the structure includes at least two of the plurality of the basic rigid stellate polygonal modules coupled at angles to each other along corresponding side edges of at least one of the at least three polygonal structures of each of the at least two basic rigid-stellate modules;

wherein additional basic rigid-stellate polygonal modules are similarly coupled together with the at least two basic rigid-stellate polygonal modules to form the structure.

2. The structure according to claim 1, wherein the rigid-stellate connector of at least one of the plurality of rigid-stellate polygonal modules is formed by a series of individual connectors located at points along an edge of said polygonal structures thereby forming said rigid-stellate connector.

3. The structure according to claim 1, wherein the rigid-stellate connector of at least one of the plurality of rigid-stellate polygonal modules is formed by a continuous linear connector located along the entire corresponding edges of said coupled polygonal structures thereby forming said rigid-stellate connector.

4. The structure according to claim 1, wherein each of the at least three polygonal structures of at least one of the plurality of rigid-stellate polygonal modules is an equilateral triangular polygon.

5. The structure according to claim 1, wherein each of the at least three polygonal structures of at least one of the plurality of rigid-stellate polygonal modules is a non-equilateral triangular polygon.

6. The structure according to claim 1 wherein the axis of the rigid-stellate connector of each of the plurality of rigid-stellate polygonal modules has two opposite ends, and wherein the side edges of the coupled at least two rigid-stellate polygonal modules are oriented so that one of the two opposite ends of the rigid-stellate connector of one of the at least two rigid-stellate polygonal modules abuts with one of the two opposite ends of the rigid-stellate connector of the other of the at least two rigid-stellate polygonal modules, thereby the coupled modules being joined with one end of an axis of each of their rigid-stellate connectors abutted.

7. The structure according to claim 1, wherein the axis of the rigid-stellate connector of the at least two rigid-stellate polygonal modules has two opposite ends, and wherein the corresponding coupled side edges of the at least two basic rigid-stellate polygonal modules are oriented so that one end of the two opposite ends of the rigid-stellate connector of one of the at least two basic rigid-stellate polygonal modules abuts with a vertex connector of ends of the at least two side edges of one of the at least three polygonal structures of the other of the at least two basic rigid-stellate polygonal modules.

8. The structure according to claim 1, wherein at least one additional linear structural element is located between two different polygonal structures at a vertex connector of ends between the at least two side edges for each of the two different polygonal structures.

9. The structure according to claim 1, wherein at least one additional linear structural element is located between any points along an edge of one of the at least two side edges of two different polygonal structures.

10. The structure according to claim 1, wherein the base edges of the at least three polygonal structures of the at least two basic rigid-stellate polygonal modules are of equal length.

11. The structure according to claim 1, wherein the base edges of the at least three polygonal structures of the at least two basic rigid-stellate polygonal modules are of different length.

12. The structure according to claim 1, wherein some of the at least three polygonal structures of the plurality of basic rigid-stellate polygonal modules in said structure are removable from either an inside or an outside of said structure to form openings in the structure while still maintaining rigidity of the structure.

13. The structure according to claim 1, wherein the rigid-stellate connector includes a double leaved planar connector, and wherein the at least three polygonal structures are each coupled by their base edges to the rigid-stellate connector by the double leaved planar connector.

14. The structure according to claim 1, wherein a single exterior geometric polyhedral framework is formed from the plurality of basic rigid-stellate polygonal modules and joined to a discrete additional interior polyhedral framework formed from the plurality of basic rigid-stellate polygonal modules.

15. The structure according to claim 1, wherein the at least two side edges of the at least three polygonal structures are of different length.

16. The structure according to claim 1, having a form being at least partial dissections of aggregations of the plurality of basic rigid-stellate polygonal modules.

17. The structure according to claim 1, wherein each edge and surface at the exterior has a corresponding but inverted edge and surface at the interior.

18. The structure according to claim 1, wherein one end of all interior edges meet at a single point.

19. The structure according to claim 1, wherein the plurality of basic rigid-stellate polygonal modules form a 30-sided polyhedron in which one end of all interior edges meet at a single point.

20. The structure according to claim 1, wherein the plurality of basic rigid-stellate polygonal modules form a 48-sided polyhedron in which one end of all interior edges meet at a single point.

21. The structure according to claim 1, having the form of 3 faceted cylindrical structures with multiple interior bulkheads, the cylindrical structures joined together in a triangular array.

22. The structure according to claim 1, wherein the plurality of basic rigid-stellate polygonal modules forms a centrally located faceted cylindrical structure having two opposite ends which flares at least at one of the opposite ends into a parasol-like faceted ellipsoid structure radiating out from the central faceted cylindrical structure.

23. The structure according to claim 1, wherein the plurality of basic rigid-stellate polygonal modules form shallow octahedrons, and wherein the shallow octahedrons are joined to form a structure with two parallel planes of joined shallow octahedrons that are joined together by other shallow octahedrons located normal to and between the two parallel planes.

24. The structure according to claim 1, wherein the plurality of basic rigid-stellate polygonal modules form tetrahedrons, and wherein the tetrahedrons are joined to form several different substantially cylindrical structures having different amounts of concavity and complexity.

25. The structure according to claim 1, wherein the plurality of basic rigid-stellate polygonal modules form tetrahedrons which are coupled into groupings of hexahedrons, and wherein the hexahedrons are joined to form a planar structure.

26. The structure according to claim 1, wherein the plurality of basic rigid-stellate polygonal modules form octahedrons and tetrahedrons, and wherein the octahedrons and the tetrahedrons are joined to form several different substantially spherical complexly concave polyhedral structures.

27. The structure according to claim 1, wherein the plurality of basic rigid-stellate polygonal modules form octahedrons and tetrahedrons, and wherein the octahedrons and tetrahedrons are joined to form several different substantially ellipsoidal complexly concave ring-like polyhedral structure.

28. The structure according to claim 1, wherein the plurality of basic rigid-stellate polygonal modules form tetrahedrons which are joined into groupings of hexahedrons, and wherein the hexahedrons are joined to form several different substantially ellipsoidal complexly concave faceted polyhedral structures.

29. The structure according to claim 1, wherein the plurality of basic rigid-stellate polygonal modules form a structure being a triakis icosohedron at its exterior and a great dodecahedron at its interior.

30. The structure according to claim 1, wherein the plurality of basic rigid-stellate polygonal modules form faceted cylindrical structures having interior bulkheads, octahedrons and tetrahedrons, and wherein the octahedrons and tetrahedrons are joined to form substantially spherical structures in a rectilinear grid joined to each other by sections of the faceted cylindrical structures having interior bulkheads.

31. The structure according to claim 1, wherein the plurality of basic rigid-stellate polygonal modules form octahedrons and tetrahedrons, and wherein the octahedrons and the tetrahedrons are joined to form four faceted substantially spherical structures which form a complex polyhedral structure by joining the four faceted substantially spherical structures together to form faceted cylindrical structures with interior bulkheads and a complex manifold chamber space between the four structures.

32. The structure according to claim 1, wherein the plurality of basic rigid-stellate polygonal modules are coupled together to form an eggcrate like structure.

33. The structure according to claim 1, wherein the plurality of basic rigid-stellate polygonal modules are coupled together to form a truss-like structure.

34. A method for assembling a structure from a family of complex polyhedral models and rigid structures having discrete interiors and exteriors, the method comprising the steps of:

assembling a first basic rigid-stellate polygonal module the module including:

providing at least three non-rectilinear polygonal structures, each having a base edge and at least two side edges;

providing at least one rigid-stellate connector;

coupling each of said at least three polygonal structures by their base edges to said connector at angles to form said first basic rigid-stellate polygonal module;

forming an additional substantially similar second basic rigid-stellate polygonal module;

joining at an angle the additional second basic rigid-stellate polygonal module to the first basic rigid-stellate polygonal module at corresponding side edges of one of the at least three polygonal structures of each of the modules; and wherein additional basic rigid-stellate polygonal modules are joined to the first basic rigid-stellate polygonal module and the additional similar second basic rigid-stellate polygonal module at the side edges of their polygonal structures, thereby progressively assembling the structure.

35. The structure according to claim 34, wherein the base edges of the at least three polygonal structures of the at least two basic rigid-stellate polygonal modules are each of different lengths.

36. The structure according to claim 34, wherein the base edge and the at least two side edges of each of the polygonal structures each have two opposite ends, wherein the rigid-stellate connector is integral with the base edge of each of the at least three polygonal structures, wherein the at least two side edges of each of the at least three polygonal structures are coupled to each other at one of their opposite ends, and wherein the other of the opposite ends of each of the at least two side edges are each coupled to the ends of the rigid-stellate connector.

37. The structure according to claim 34, wherein the plurality of basic rigid-stellate polygonal modules form shallow octahedrons and tetrahedrons, wherein the shallow octahdrons and tetrahedrons are coupled together to provide a structure having the form of a faceted ellipsoid with opposite ends and a perimeter, and wherein the faceted ellipsoid is coupled by the perimeter to three additional polyhedral structures, and which also includes an interior with a centrally located faceted cylindrical structure having two opposite ends which flares at each of the opposite ends into the opposite ends of the faceted ellipsoid.

38. A rigid stellate building module for constructing complex polyhedrons and structures, the module comprising:

at least three non-rectilinear polygonal structures, each polygonal structure having a base edge and at least two side edges; and a rigid stellate connector coupled to the base edge of each of the at least three polygonal structures to form a rigid stellate polygonal building module;

wherein an angle is subtended between each of the at least three polygonal structures in relation to its adjacent polygonal structure; and wherein the side edges of at least one of the polygonal structures are rigidly coupled at an angle to side edges of other polygonal structures of other rigid stellate building modules to form complex polyhedrons.

39. The module according to claim 38, wherein the rigid-stellate building module is included in a polyhedral structure having an interior and an exterior, at least one polygonal structure of the stellate building module extends into the interior of the polyhedral structure, and at least one other polygonal structure of the stellate building module forms the exterior of the polyhedral structure.

40. The module according to claim 38 wherein the size of the rigid stellate connector coupled to the base edge is substantially equal to the dimension of the base and side edges.

41. The module according to claim 34, wherein each of the at least three polygonal structures is an equilateral triangular polygon.

42. The module according to claim 34, wherein each of the at least three polygonal structures is a non-equilateral triangular polygon.

43. The module according to claim 34, wherein each of the at least three polygonal structures are formed by a plurality of linear struts having two opposite ends, and wherein at least one additional linear strut is located between any point between the two opposite ends of the linear struts of at least two different polygonal structure of the complex polyhedrons.

44. The module according to claim 34, wherein at least one additional linear structural element is located between two different polygonal structures at a vertex connector between the at least two side edges for each of the two different polygonal structures.

45. The module according to claim 34, wherein at least one additional linear structural element is located between two different polygonal structures at a vertex connector between the at least two side edges of one polygonal structure and at one end of the axis of the stellate connector of the other polygonal structure.

46. The module according to claim 34, wherein the rigid stellate connector includes double leaved planar forms for matingly engaging the said at least three polygonal structures.

47. A rigid stellate building module for constructing complex concave polyhedrons and structures, the module comprising:

at least three non-rectilinear polygonal structures, each polygonal structure having a base edge and at least two side edges; and a rigid stellate connector coupled to the base edge of each of the at least three polygonal structures to form a rigid stellate building module;

wherein an angle is subtended between each of the at least three polygonal structures in relation to its adjacent polygonal structure; and wherein the side edges of the polygonal structures are coupled at angles to side edges of other polygonal structures of other stellate building modules to form complex polyhedrons; and wherein the rigid stellate connector of the stellate building module is integral with the base edge of the at least three polygons.

48. A structure from a family of concave polyhedral models and rigid structures having discrete interior and exterior structural elements, the structure comprising:

the multiple assembly of several basic rigid stellate non-rectilinear polygonal modules, said basic modules formed of at least three non-rectilinear polygons having one base edge and at least two additional side edges, said non-rectilinear polygons being rigidly stellately joined along corresponding base edges of said polygons, said additional side edges of each of said polygons each being joined to at least one other edge of a polygon of another basic stellate module.

49. The structure according to claim 48, wherein at least one additional linear structural element is located between two different polygonal structures.

50. A structure from a family of concave polyhedral models and rigid structures having discrete interior and exterior structural elements, the structure comprising:

a plurality of basic rigid stellate non-rectilinear polygonal modules, each module including:

the rigid stellate joinder of at least three base edges of three different non-rectilinear polygons, the remaining side edges of said polygons joined to at least one other edge of an additional polygon, at least one of the polygons located at the exterior surface of a concave polyhedron, at least one of the polygons extending away from the exterior surface and to the interior of a concave polyhedron, the angles subtended between both the joinder of the at least three polygons at their base edges and the joinder of the remaining side edges joined to the at least one other edge of the additional polygon form the structure.

51. A structure from a family of complex concave polyhedral models and rigid structures having discrete interior and exterior structural elements, the structure comprising:

a plurality of basic non-rectilinear polygonal modules, each module including:

at least three at least three-sided polygons each polygon having a base edge and at least two side edges;

the base edges of each of said polygons joined to an at least three-stellate rigid connector;

the remaining side edges of the polygons each being joined to an at least two-stellate rigid connector, a plurality of said polygonal modules coupled together to form the structure.

52. The structure according to claim 51, wherein a plurality of the basic non-rectilinear polygonal modules are coupled together comprising a stellate module:

wherein the base edge of the basic non-rectilinear polygonal module is coupled through said three-stellate connector to at least two other edges of two other additional at least three-sided non-rectilinear polygonl structures;

wherein the two side edges of the basic non-rectilinear polygonal module are each coupled through said at least two-stellate connector to at least one other edge of another additional at least three-sided non-rectilinear polygonal structure, thereby comprising said stellate module;

wherein a plurality of the stellate modules are coupled together to form the structure.

53. A structure from a family of polyhedral models and rigid structures having discrete interior and exterior structural elements formed from the multiple use of a basic rigid stellate multiple polygonal module the module comprising:

at least three non-rectilinear polygonal structures, each of the polygonal structures having a base edge and at least two side edges, at least one rigid at least three-stellate connector, said polygonal structures each joined at their base edges to said rigid stellate connector thereby forming said basic rigid stellate multiple polygonal module, angles are subtended between each of the adjacent two of the at least three polygonal structures of the basic module, at least two of the basic rigid stellate modules being joined at angles to each other along at least one abutted side edge of one of the polygons of each of the joined modules, wherein additional basic rigid stellate modules are similarly connected together with the at least two basic rigid stellate modules to form the structure.

54. The structure according to claim 53, wherein the base edges of the at least three polygonal structures of the at least two basic rigid-stellate polygonal modules are each of different length.

55. The structure according to claim 53, wherein the at least two side edges of each of the at least three polygonal structures are of different length.

56. The structure according to claim 53, wherein the at least two side edges of each of the at least three polygonal structures are of different length to the base edge.

57. The structure according to claim 53, wherein the at least two side edges of each of the at least three polygonal structures are of different length to their base edges comprising a substantially isoceles right triangular structure.

* * * * *